US009781976B2

(12) United States Patent
Stockton et al.

(10) Patent No.: US 9,781,976 B2
(45) Date of Patent: Oct. 10, 2017

(54) SHOE TREATMENT

(71) Applicant: Dukoz LLC, Los Angeles, CA (US)

(72) Inventors: Maureen E. Stockton, Los Angeles, CA (US); Eddie Paul, El Segundo, CA (US); Robert R. Tucker, Torrance, CA (US)

(73) Assignee: DUKOZ LLC, Los Angeles, CA (US)

( * ) Notice: Subject to any disclaimer, the term of this patent is extended or adjusted under 35 U.S.C. 154(b) by 120 days.

(21) Appl. No.: 14/281,793

(22) Filed: May 19, 2014

(65) Prior Publication Data

US 2015/0327629 A1 Nov. 19, 2015

(51) Int. Cl.
*A43D 3/14* (2006.01)
*A43D 3/08* (2006.01)

(52) U.S. Cl.
CPC ..... *A43D 3/08* (2013.01); *A43D 3/145* (2013.01); *A43D 3/1441* (2013.01); *A43D 3/1466* (2013.01); *A43D 3/1475* (2013.01)

(58) Field of Classification Search
USPC ..... 12/116.2
See application file for complete search history.

(56) References Cited

U.S. PATENT DOCUMENTS 189,418 A * 4/1877 Batley ..... A43D 3/1416 12/114.6
229,156 A * 6/1880 Lyons ..... A43D 3/08 12/115.2
232,478 A * 9/1880 Fay ..... A43D 3/08 12/117.2
293,448 A * 2/1884 Glines ..... A43D 3/1475 12/117.4
653,575 A * 7/1900 Pabst ..... A43D 3/08 12/115.2
653,778 A * 7/1900 Hall ..... A43D 3/1475 12/117.4

(Continued)

FOREIGN PATENT DOCUMENTS

CH 286472 A 10/1952
DE 3431904 A 3/1986

(Continued)

OTHER PUBLICATIONS

Wikipedia, "Bistability", [online], [retrieved on Mar. 22, 2013]. Retrieved from the Internet at <URL: http://en.wikipedia.org/wiki/Bistability>, Total 4 pp.

(Continued)

*Primary Examiner* — Khoa Huynh
*Assistant Examiner* — Jocelyn Wu
(74) *Attorney, Agent, or Firm* — Konrad Raynes Davda & Victor LLP

(57) ABSTRACT

In accordance with one aspect of the present description, a shoe treatment device is provided having a shoe interior engagement form expandable from a latched, contracted state to an expanded state. A user operated slide actuator positioned exterior to the shoe may drive the engagement form to expand to the expanded state. The slide actuator may be actuated to contract the engagement form back to the contracted state. A latch may latch the engagement form in the selected contracted or expansion state to facilitate insertion and removal and treatment of the shoe. Other aspects are described.

19 Claims, 15 Drawing Sheets

(56) References Cited

U.S. PATENT DOCUMENTS 674,013 A * 5/1901 Pabst ..... A43D 3/1475 12/117.4
675,187 A * 5/1901 Baker ..... A43D 3/08 12/117.2
713,482 A 11/1902 McKnight
795,871 A * 8/1905 Watson ..... A47L 23/18 12/116.2
830,632 A * 9/1906 Anderson ..... A47L 23/18 12/116.2
965,865 A * 8/1910 Brock ..... A43D 3/1466 12/116.4
969,165 A * 9/1910 Kosters ..... A43D 3/1466 12/115.6
1,062,164 A * 5/1913 Kobert ..... A43D 3/1475 12/117.4
1,062,165 A * 5/1913 Kobert ..... A43D 3/08 12/116.2
1,222,470 A * 4/1917 Ross ..... A43D 3/1466 12/115.6
1,356,509 A 10/1920 Anderson
1,444,010 A 2/1923 Shimp
1,465,270 A 8/1923 Howe
1,527,662 A 2/1925 Anderson
1,599,900 A 9/1926 Kosters
1,632,044 A * 6/1927 Schoshusen ..... A43D 3/1441 12/116.6
1,660,912 A * 2/1928 Brock ..... A43D 3/08 12/116.2
1,720,479 A * 7/1929 Kanell ..... A43D 3/08 12/116.2
1,746,466 A * 2/1930 Galterio ..... A43D 3/08 12/116.2
1,761,012 A * 6/1930 Fitz ..... A43D 3/08 12/117.2
1,830,016 A 11/1931 Clausing
2,018,406 A * 10/1935 Legge ..... A43D 3/1475 12/117.4
2,018,407 A * 10/1935 Legge ..... A43D 3/1441 12/116.6
2,018,408 A * 10/1935 Legge ..... A43D 3/1475 12/116.6
2,023,618 A * 12/1935 Schecter ..... A43D 3/08 12/117.2
2,063,370 A * 12/1936 Dutton ..... A43D 3/08 12/116.2
2,068,232 A * 1/1937 Gershune ..... A43D 3/1475 12/117.4
2,069,537 A * 2/1937 Panos ..... A43D 3/08 12/116.2
2,070,234 A * 2/1937 Loeffler ..... A43D 3/1433 12/115.2
2,075,412 A * 3/1937 Ward ..... A43D 3/08 12/116.2
2,084,748 A * 6/1937 Schiller ..... A43D 3/08 12/117.2
2,104,839 A 1/1938 Panos
2,203,792 A * 6/1940 Loney ..... A43D 3/1466 12/115.8
2,215,835 A * 9/1940 Mutch ..... A43D 3/1466 12/115.8
2,233,454 A * 3/1941 Koskela ..... A43D 3/08 12/116.2
2,255,471 A * 9/1941 Mutch ..... A43D 3/1466 12/115.8
2,295,359 A * 9/1942 Schiller ..... A43D 3/08 12/117.4
2,303,469 A 12/1942 Janic
2,361,531 A * 10/1944 Clausing ..... A43D 3/1441 12/116.6
2,362,237 A 11/1944 Bernstein
2,376,926 A 5/1945 Loewer
2,424,669 A * 7/1947 Rinnela ..... A43D 3/08 12/116.2
2,443,792 A * 6/1948 King ..... A43D 3/1458 12/116.2
2,473,176 A * 6/1949 Schoshusen ..... A43D 3/1441 12/115.8
2,473,207 A 6/1949 Kessler
2,488,720 A * 11/1949 Galterio ..... A43D 3/08 12/116.2
2,501,285 A * 3/1950 Minton ..... A43D 3/1475 12/116.2
2,511,366 A * 6/1950 Muzinich ..... A43D 3/08 12/116.2
2,513,664 A 7/1950 Mutch
2,549,502 A * 4/1951 McClenathan ..... A43D 3/08 12/117.2
2,628,375 A 2/1953 Smithson
2,634,439 A * 4/1953 Fitzpatrick ..... A43D 3/1458 12/116.2
2,673,360 A * 3/1954 Bascom ..... A47L 23/18 12/114.2
2,689,365 A * 9/1954 Koskela ..... A43D 3/08 12/115.2
2,714,217 A * 8/1955 Dore ..... A43D 3/08 12/115.2
2,789,294 A * 4/1957 Doherty ..... A43D 3/1458 12/116.2
2,872,692 A * 2/1959 Moses ..... A43D 3/1441 12/115.8
2,879,527 A * 3/1959 Davis ..... A43D 3/1466 12/115.8
3,860,986 A * 1/1975 Ballard ..... A43D 3/08 12/115.2
3,877,100 A * 4/1975 Harvey ..... A43D 3/08 12/115.2
3,986,221 A * 10/1976 Thompson ..... A43D 3/1416 12/114.8
4,512,052 A * 4/1985 Bruno ..... A43D 3/08 12/116.2
4,577,360 A * 3/1986 Swenson ..... A43D 3/1466 12/114.2
4,718,135 A * 1/1988 Colvin ..... A43D 3/1466 12/114.2
5,136,746 A * 8/1992 Jones ..... A43D 3/025 12/116.2
D331,828 S 12/1992 Issler
6,550,088 B1 * 4/2003 Chang ..... A43D 3/1475 12/114.2
6,883,197 B2 * 4/2005 Tak ..... A43D 3/1408 12/115.8
7,287,293 B2 * 10/2007 Cook ..... A43D 3/145 12/114.2
7,757,325 B2 * 7/2010 Cook ..... A43D 3/145 12/142 R
7,980,007 B2 * 7/2011 Cook ..... A43D 3/145 36/45
7,992,243 B2 * 8/2011 Cook ..... A43D 3/145 12/142 R
8,001,642 B2 8/2011 Bordin et al.
8,032,962 B1 * 10/2011 Payne ..... A43D 3/1483 12/115.8
9,107,479 B2 * 8/2015 Hanson ..... A43D 3/04
2003/0041394 A1 * 3/2003 Tak ..... A43D 3/1408 12/115.8
2003/0046778 A1 3/2003 Sicurelli, Jr.
2006/0168742 A1 * 8/2006 Chang ..... A43D 3/145 12/115.8
2007/0033750 A1 * 2/2007 Cook ..... A43D 3/145 12/134
2009/0044429 A1 * 2/2009 Cook ..... A43D 3/145 36/113
2010/0275392 A1 * 11/2010 Cook ..... A43D 3/145 12/52.5
2011/0277250 A1 * 11/2011 Langvin ..... A43B 3/0084 12/133 R
2012/0192365 A1 8/2012 Ottenstein

(56) References Cited

U.S. PATENT DOCUMENTS

| | | | | |
|---|---|---|---|---|
| 2013/0291317 | A1* | 11/2013 | Hanson | A43D 3/04 12/133 R |
| 2014/0075688 | A1* | 3/2014 | Langvin | A43B 3/0084 12/133 R |
| 2017/0095039 | A1 | 4/2017 | Stockton et al. | |

FOREIGN PATENT DOCUMENTS

| | | | |
|---|---|---|---|
| FR | 941278 | A | 1/1949 |
| FR | 982758 | A | 6/1951 |
| GB | 191308074 | A | 0/1914 |
| WO | 0147388 | A | 5/2001 |
| WO | WO2015179319 | A2 | 11/2015 |

OTHER PUBLICATIONS

Wikipedia, "Shoe Tree", [online], [retrieved on Mar. 22, 2013]. Retrieved from the Internet at <URL: http://en.wikipedia.org/wiki/Shoetree>, Total 1 p.

International Search Report and Written Opinion, Nov. 24, 2015, for PCT/US2015/031437, Total 18 pp.

English Abstract for DE3431904A1, published on Mar. 13, 1986, Total 1 p.

English Abstract for GB191308074A, published on Jan. 22, 1914, Total 1 p.

International Preliminary Report, Dec. 1, 2016, for International Application No. PCT/US2015/031437, Total 13 pp.

Amendment for EP Application No. 15726474.8, dated Jun. 8, 2017, 20 pp.

* cited by examiner

SHOE TREATMENT

BACKGROUND

Description of Related Art

A device often referred to as a "shoe tree" may be inserted into a shoe to help maintain the shape of the shoe while the shoe is being stored until the shoe is worn again. Such a shape protection device typically has one or more components often referred to as a "form" which are shaped to resemble portions of a human foot. These components are often made of wood such as cedar to absorb moisture and control odors.

Other shoe devices are intended to enlarge a shoe. Such shoe stretching devices may include an expansion mechanism to stretch at least a portion of the shoe.

Some shoe devices are fixed in size and shape. Other shoe devices have multiple components linked by various mechanical devices which may be adjusted or actuated to change the size or shape of the shoe device. For example, a threaded bolt linking toe and heel components may be rotated to change the length of the shoe device to one suitable for a particular shoe size. Other designs may have components linked by springs to apply pressure to the interior of the shoe. Still other designs may have a pivoting over-center mechanical device to drive components of the shoe device in place within the interior of the shoe.

BRIEF DESCRIPTION OF THE DRAWINGS

Referring now to the drawings in which like reference numbers represent corresponding parts throughout.

DETAILED DESCRIPTION OF THE ILLUSTRATED EMBODIMENTS

In the following description, reference is made to the accompanying drawings which form a part hereof and which illustrate several embodiments of the present disclosure. It is understood that other embodiments may be utilized and structural and operational changes may be made without departing from the scope of the present description.

Figure 1:
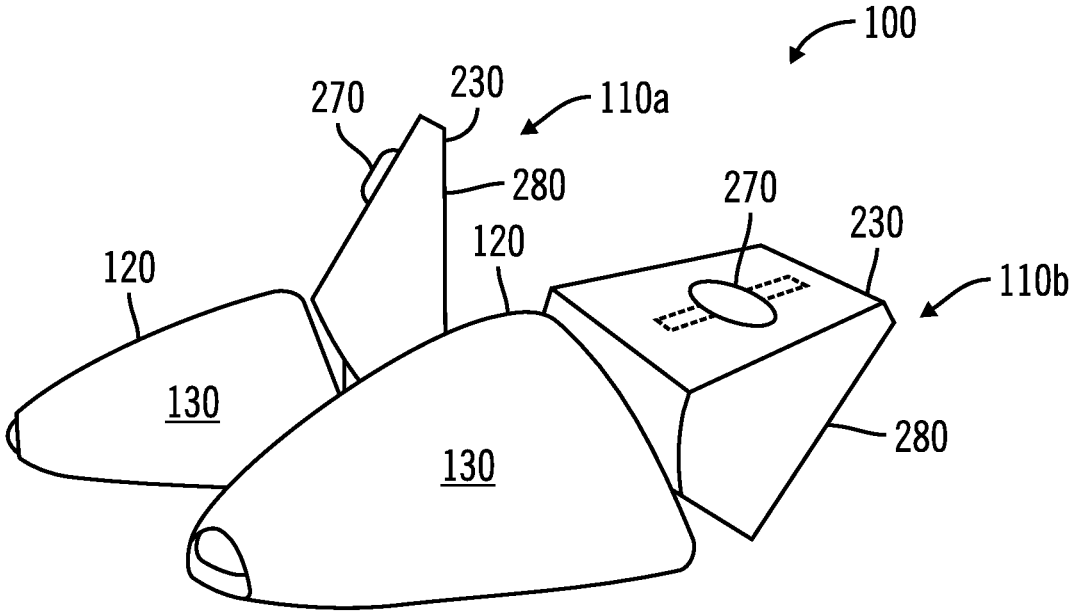
FIG. 1 illustrates one embodiment of a pair of shoe treatment devices in accordance with the present description.

FIG. 1 depicts a pair 100 of shoe shape protection and enhancement products referred to herein as "shoe treatment devices" 110*a*, 110*b* in accordance with one embodiment of the present description. It is believed that the shoe treatment devices 110*a*, 110*b* may be used to substantially maintain the original shape and fit of a shoe to substantially retain the integrity of design and long term value of the shoes. In addition, the shoe treatment devices 110*a*, 110*b* may be used to stretch a shoe in those instances in which a larger size or shape is appropriate. Thus, shoe stretching in addition to shoe shape maintenance may be selected, depending upon the needs of the particular user. Moreover, the degree of stretching, if any may also be readily selected by the user. Other aspects may be realized, depending upon the particular application.

Figure 2A:
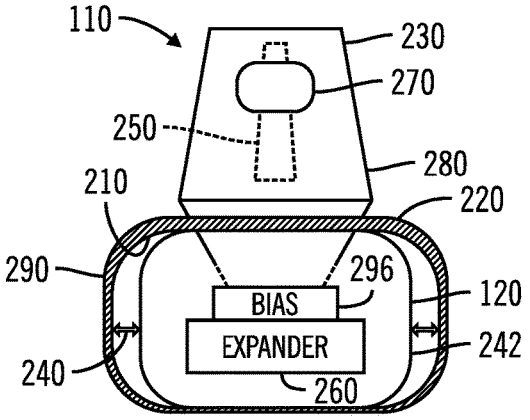
FIG. 2*a* is a front, schematic, cross-sectional view as viewed along the lines 2*a*-2*a* of FIGS. 3 and 2*a*-2*a* of FIG. 4*a*, illustrating one embodiment of a shoe treatment device in accordance with the present description, in which an expandable shoe interior engagement form is depicted in a latched, laterally contracted state and in a vertically expanded state, while inserted into a shoe.

In one aspect, each shoe treatment device 110*a*, 110*b* has an expandable shoe interior engagement form 120 which is enclosed in a fabric shroud or enclosure 130 similar to a human sock. The interior engagement form 120 has a first size in a latched, contracted state as depicted for the shoe treatment device 110*a* of FIG. 1, and a second size in a latched, expanded state as depicted for the shoe treatment device 110*b* of FIG. 1. FIG. 2*a* is a schematic diagram depicting in schematic form, an example of an expandable shoe interior engagement form 120 of a shoe treatment device 110 in accordance with the present description, inserted in a latched, contracted state, into the interior 210 of a shoe 220, depicted in a cross-sectional view along the lines 2*a*-2*a* of FIGS. 3, 4*a*. FIG. 4*a* is a side view schematic diagram of the shoe treatment device of FIG. 2*a*.

In one embodiment, the expandable shoe interior engagement form 120 is configured to be inserted into the interior of the toe box or toe box area 224 (FIG. 3) of the shoe 220, with a slide actuator 230 of the shoe treatment device 110 extending outside of the shoe 220. It is appreciated however, that an expandable shoe interior engagement form in accordance with the present description may be inserted into other areas of the interior of the shoe, depending upon the particular application. Also, the slide actuator 230 may be positioned wholly within the shoe interior 210 in some embodiments.

In the embodiment of FIGS. 2*a*, 4*a* the expandable shoe interior engagement form 120 has an exterior size in the lateral direction which is smaller than that of the interior 210 of the toe box 224 (FIG. 3) of the shoe 220 when the expandable shoe interior engagement form 120 is in the latched, laterally contracted state. As a result, a lateral gap space as represented by the arrows 240 is formed between the outer surface 242 of the expandable shoe interior engagement form 120 of the shoe treatment device 110, and the interior 210 defined by an interior surface of the shoe 220.

In the latched, laterally contracted state, the shoe treatment device 110 facilitates ready insertion of the expandable shoe interior engagement form 120 of the shoe treatment device into the interior of a shoe 220 or ready removal from the interior of the shoe 220. For example, inserting the expandable shoe interior engagement form 120 of the shoe treatment device 110*a* in a latched, laterally contracted, state may facilitate inserting the shoe treatment device farther into the toe box area 224 of the shoe. Thus, the expandable toe box interior engagement form 120 latched in the contracted state may be readily withdrawn from the toe box area or inserted into the toe box area as appropriate. In contrast, prior shoe treatment devices frequently are made of inflexible materials such that the user may jam the prior shoe treatment device into the shoe and damage or improperly stretch delicate materials of the shoe. Conversely, such prior shoe treatment devices may be difficult to extract for users having limited strength or fine motor movement in their hands and fingers.

Figure 4A:
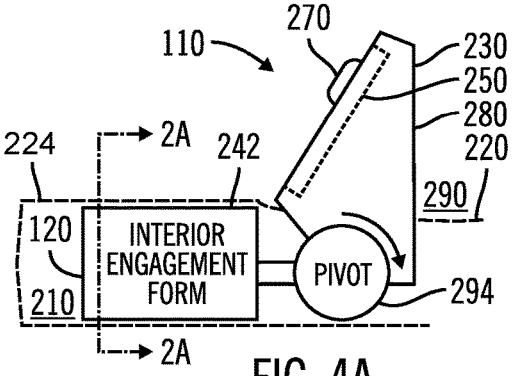
FIG. 4*a* is a side, schematic diagram, illustrating the shoe treatment device of FIG. 2*a* in which the expandable shoe interior engagement form is depicted in a latched, laterally contracted state and in a vertically expanded state, while inserted into a shoe.
Figure 2B:
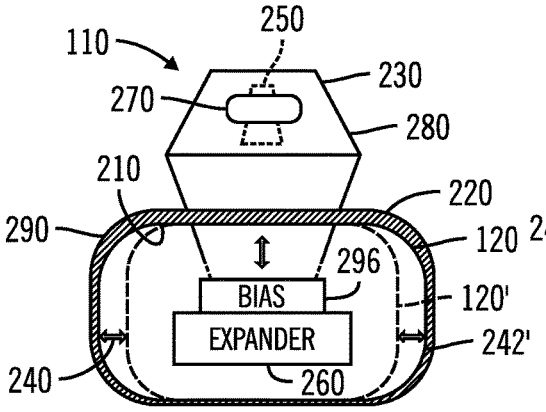
FIG. 2*b* is a front, schematic, cross-sectional view as viewed along the lines 2*b*-2*b* of FIG. 4*b*, illustrating the shoe treatment device of FIG. 2*a*, in which the expandable shoe interior engagement form is depicted in a latched, laterally expanded state and in a vertically expanded state, while inserted into a shoe.
Figure 4B:
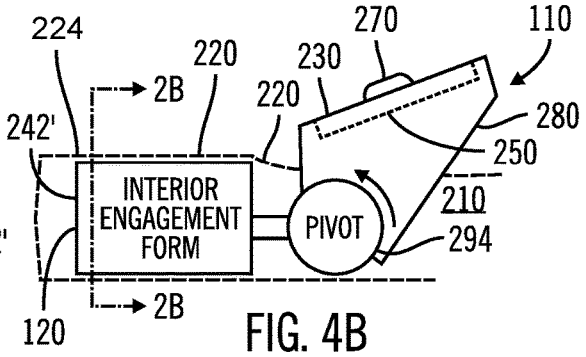
FIG. 4*b* is a side, schematic diagram, illustrating the shoe treatment device of FIG. 2*b* in which the expandable shoe interior engagement form is depicted in a latched, laterally expanded state and in a vertically expanded state, while inserted into a shoe.

As explained in greater detail below, the shoe treatment device 110 may be unlatched and the slide actuator 230 actuated from the exterior of the shoe, to expand the form 120 to a first selected, laterally expanded state as shown in FIG. 2*b*. FIG. 4*b* is a side view schematic diagram of the shoe treatment device of FIG. 2*b*. In this expanded state, the form 120 has laterally expanded from the size of FIG. 2*a* indicated in phantom at 120' in FIG. 2*b*, to fit and conform to the intended area of the interior of the shoe. In the first expanded state of FIG. 2*b*, the outer surface of the expandable shoe interior engagement form 120 engages the inner surface of the interior 210 of the shoe 220, as indicated at 242'. In one application, the first expanded position 242' may represent a suitable expansion position for shoe shape maintenance.

Figure 2C:
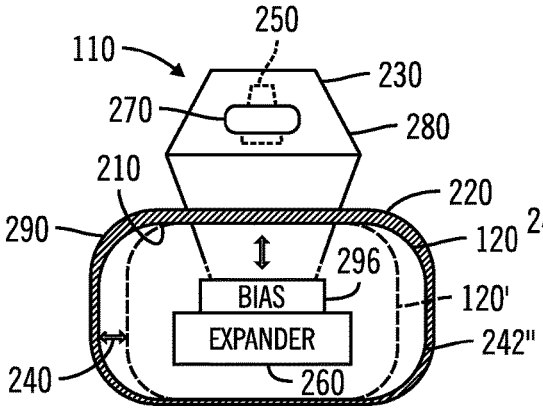
FIG. 2*c* is a front, schematic, cross-sectional view as viewed along the lines 2*c*-2*c* of FIG. 4*b*, illustrating the shoe treatment device of FIG. 2*a*, in which the expandable shoe interior engagement form is depicted in a latched, and further laterally expanded state and in a vertically expanded state, while inserted into a shoe.
Figure 4C:
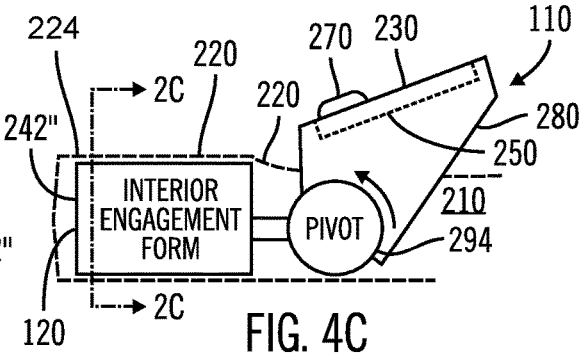
FIG. 4*c* is a side, schematic diagram, illustrating the shoe treatment device of FIG. 2*c* in which the expandable shoe interior engagement form is depicted in a latched, and further laterally expanded state and in a vertically expanded state, while inserted into a shoe.

In another aspect of the present description, continued actuation of the slide actuator 230 may provide for further expansion to a second selected, more expanded state, as shown in FIG. 2*c*. FIG. 4*c* is a side view schematic diagram of the shoe treatment device of FIG. 2*c*. In this expanded state, the form 120 has laterally expanded again from the size of FIG. 2*a* indicated in phantom at 120' in FIG. 2*c*, to fit and conform to the intended area of the interior of the shoe. In the second expanded state of FIG. 2*c*, the outer surface of the expandable shoe interior engagement form 120 engages the inner surface of the interior 210 of the shoe 220, as indicated at 242". In one application, the second expanded position 242" may represent a suitable expansion position for shoe stretching as well as shape maintenance.

Still further, the slide actuator 230 may be latched by a latch 250 to latch the shoe treatment device 110*a* in the selected contracted or expanded state. Although the figures depict a few examples of different selectable positions of the slide actuator 230 and different states of the interior engagement form 120, it is appreciated that the actuator 230 of the illustrated embodiment has a wide range of selectable positions corresponding to a wide range of interior engagement form sizes and shapes. Thus, the shoe treatment device may be latched in one of many different selectable contracted or expanded states (as represented by the examples of FIGS. 2*a*-2*c*), depending upon the position of the slide actuator 230, the position of the interior engagement form 120 within the shoe, and the particular size, shape and properties of the shoe being treated. In this manner, the degree of lateral expansion may be readily selected and configured to provide a suitable amount of shape maintenance or shoe stretching as appropriate for the user.

Figure 3:
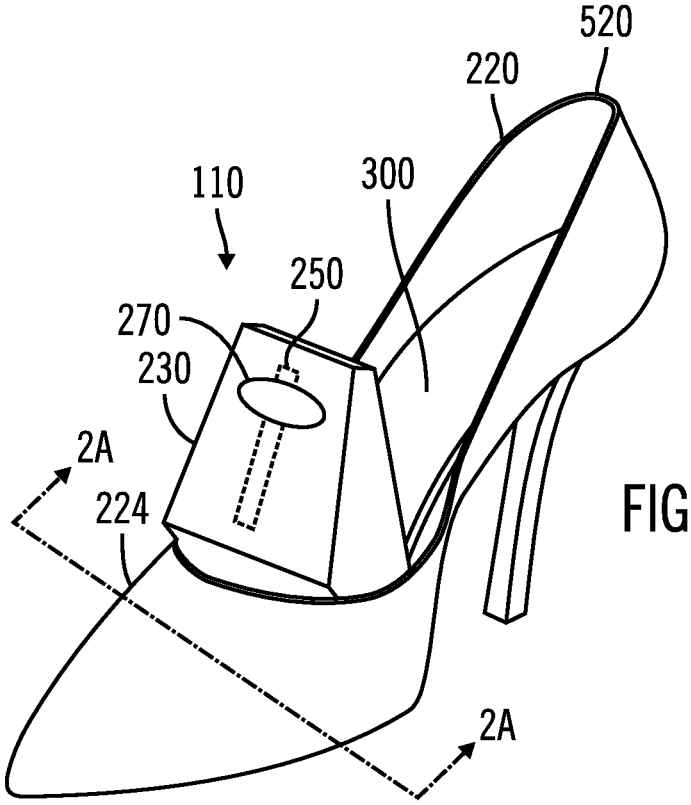
FIG. 3 depicts a shoe treatment device of FIG. 1 inserted into a shoe.

In the illustrated embodiment, the shoe treatment device 110 of FIG. 3 is shown inserted into the shoe 220 which, in the example of FIG. 3, is a women's pump style shoe. The shoe treatment devices of the present description are shaped to fit a multitude of shoe styles including, for example, pumps that have a curvature in the arch area 300. It is appreciated however, that a shoe treatment device in accordance with the present description may be used in a variety of different types of men's and women's shoes, including, for example, flats, boots, booties, athletic shoes, dress shoes, boat shoes, etc.

In another aspect of the present description, to operate the slide actuator 230 of the shoe treatment device 110, the latch 250 of the shoe treatment device 110 may be released, which permits the slide actuator 230 to be moved by the user toward the toe of the shoe, which causes a device, an expander 260 to apply an engaging force to expand the expandable shoe interior engagement form 120 to a larger size such as the first expanded state as shown in FIG. 2*b*, for example. In the first expanded state of FIG. 2*b*, the shoe treatment device may be latched again by the latch 250 so that the outer surface of the expandable shoe interior engagement form 120 is latched in this first selected expanded position so that it engages the inner surface of the interior 210 of the shoe 220, as indicated at 242'.

In another aspect of the present description, the user may before relatching the shoe treatment device 110, optionally continue to further slide the slide actuator 230 toward the toe of the shoe, which causes the expander 260 to further apply the engaging force to further expand the expandable shoe interior engagement form 120 to a still larger size such as the second selected expanded state as shown in FIG. 2*c*, for example. Once the appropriate expanded position has been reached, the shoe treatment device may be relatched by the latch 250 so that the shoe treatment device 110 holds the selected expansion position to treat the shoe as appropriate.

In the illustrated embodiment, the slide actuator 230 includes a user-manipulatable knob 270 which is positioned remotely from the expandable shoe interior engagement form 120 of the shoe treatment device. In the example of FIG. 1, the user-manipulatable knob 270 is a button which when depressed, releases the latch 250, permitting the a user-manipulatable knob 270 of the slide actuator 230 to slide, causing the expandable shoe interior engagement form 120 to expand to a larger size in an expanded state such as one of the states shown in FIG. 2*b* or 2*c*, for example. Although depicted as a button type slide actuator, it is appreciated that other types of actuator mechanisms may be utilized. For example, threaded shafts, ratchets and over center mechanisms may be used, depending upon the particular application.

As best seen in FIGS. 4*a*-4*c*, the user-manipulatable knob 270 is supported on an arm 280 of the slide actuator 230 of the shoe treatment device 110. The actuator arm 280 extends to the exterior 290 of the shoe 220 when the expandable shoe interior engagement form 120 is positioned in the interior 210 of the shoe 220. By positioning the user-manipulatable knob 270 remotely such that it extends to the exterior of the shoe 220, it is believed that user operation of the user-manipulatable knob 270 to deploy the expandable shoe interior engagement form 120 to a deployed, expanded state may be facilitated since the knob 270 may remain on the exterior of the shoe throughout deployment of the form 120 to the selected expanded and contracted states. It is appreciated however that in other embodiments, the user-manipulatable knob 270 may be positioned fully in the interior of the shoe 220 or partially in the interior of the shoe 220, depending upon the particular application.

In another aspect of the present description, the arm 280 supporting the slide actuator 230 is pivotally coupled to a base 292 (FIG. 8*c*) of the interior engagement form 120, by a pivot 294, which permits the arm 280 to pivot down from a more upright position depicted in FIG. 4*a*, to a lowered depicted in FIGS. 4*b* and 4*c*. It is believed that such a pivoting capability may assist the user in finding a comfortable position to actuate the slide actuator 230 between selected contracted and expanded states of the form 120.

In the illustrated embodiment, the arm 280 may be pivoted between the upright position of FIG. 4*a* and the lowered position depicted in FIGS. 4*b*, 4*c* independently of whether the shoe interior engagement form 120 is in a contracted or deployed (expanded) state, or latched or unlatched state. Similarly, the arm 280 may be pivoted between the upright position of FIG. 4*a* and the lowered position depicted in FIGS. 4*b*, 4*c* independently of whether the slide actuator 230 is in a contracted or deployed (expanded) position or latched or unlatched state. However, it is appreciated that in some embodiments, user supplied manual movement of the arm 280 may provide the motive force to cause the expansion of the expandable shoe interior engagement form 120. In other embodiments, an expansion force may be provided by other devices such as air pressure or memory shapes, for example, depending upon the particular application.

As explained in greater detail below, to facilitate removal of the shoe treatment device 110 from the interior of the shoe 220, in another aspect of the present description, the user may again depress the user-manipulatable knob 270 to release the latch 250, and slide the slide actuator 230 rearward back to the position depicted in FIGS. 2*a*, 4*a*. As the user-manipulatable knob 270 of the slide actuator 230 is slid back away from the toe portion of the shoe, the slide actuator 230 permits a biasing device 296 (FIG. 2*a*) to contract the expandable shoe interior engagement form 120 to the smaller size of the contracted, stowed position of FIGS. 2*a*, 4*a*, to relieve the lateral pressure of engagement between the outer surface 242 of the expandable shoe interior engagement form 120 with the inner surface of the interior 210 of the shoe 220. As a consequence, the expandable shoe interior engagement form 120 of the shoe treatment device 110 may be readily removed from the shoe 220 to permit the shoe to be worn by the user.

In another aspect, the biasing device 296 biases the interior engagement form 120 to expand in the vertical direction to apply engaging force to the upper portion of the interior 210 of the shoe 220. In one embodiment, the vertical bias force provided by the biasing device 296 may operate independently of the lateral engaging force provided by the expander 260 of the interior engagement form 120 in response to user actuation of the slide actuator 230.

In the illustrated embodiment, the arm 280 operates as a pivotally connected lever arm. It is appreciated that in other embodiments, the slide actuator 230 may be carried by mechanical devices other than lever arms, for example.

Figure 5A:
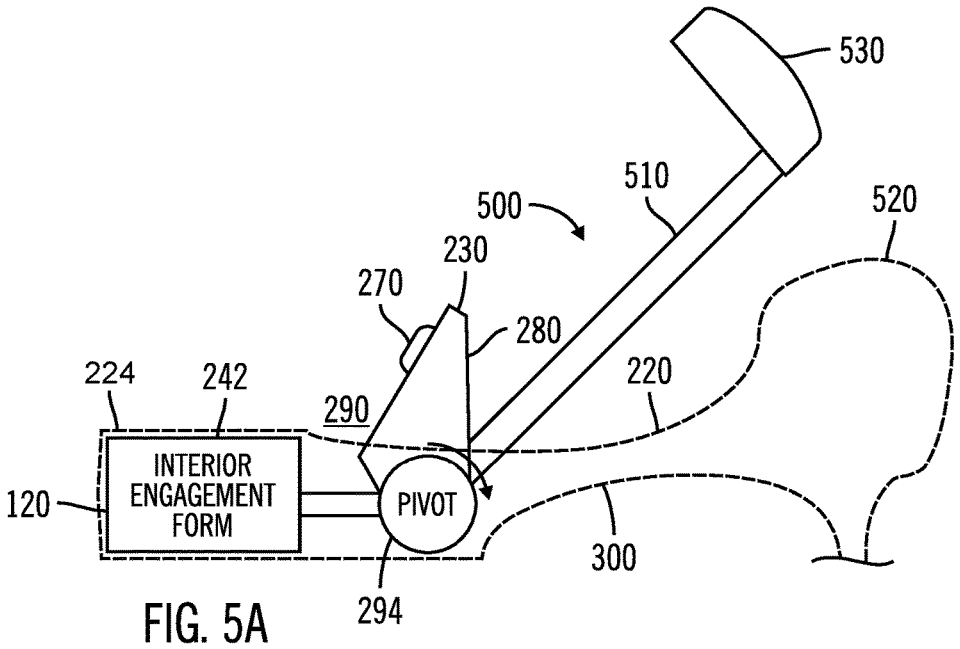
FIG. 5*a* is a side, schematic diagram, illustrating another shoe treatment device in accordance with another embodiment of the present description in which a rear extension member is depicted pivoted up out of a shoe while the expandable shoe interior engagement form is depicted inserted into the shoe.
Figure 5B:
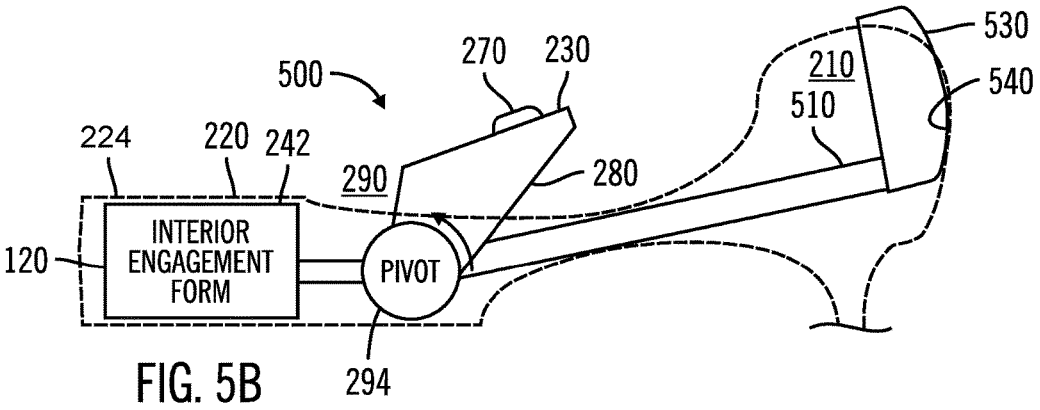
FIG. 5*b* is a side, schematic diagram, illustrating the shoe device of FIG. 5*a* in which the rear extension member is depicted pivoted down and into the interior of the shoe while the expandable shoe interior engagement form is depicted inserted into the shoe.

In the embodiment of FIGS. 2*a*-4*c*, the shoe treatment device 110 is depicted as having the expandable shoe interior engagement form 120 configured to be inserted into the toe box portion of a shoe. It is appreciated however that a shoe treatment device in accordance with the present description may have other shoe interior engagement forms in addition to or instead of the toe box interior engagement form 120 discussed above. For example, FIGS. 5*a*, 5*b* show a shoe treatment device 500 having a rear extension member 510 which extends rearward from the pivot 294 toward the heel or counter 520 of a shoe 220. The rear extension member 510 may be pivotally connected to the base 292 in a manner similar to that of the actuator arm 280. Thus, the rear extension member 510 may be pivoted downward from the position depicted in FIG. 5*a* until a counter interior engagement member 530 disposed on the distal end of the rear extension member 510 engages the counter interior 540 at the rear of the shoe interior 210. In this manner, the longitudinal shape and heel shape of the shoe 220 may be maintained by the shoe treatment device 500 while the shoe is being stored.

Conversely, the rear extension member 510 may be pivoted upward from the position depicted in FIG. 5*b* until the counter interior engagement member 530 disposed on the distal end of the rear extension member 510 no longer engages the counter interior 540 at the rear of the shoe interior 210. In this manner, the removal of the shoe treatment device 500 from the shoe 220 may be facilitated, particularly if the expandable shoe interior engagement form 120 has contracted to the smaller size of the contracted, stowed position of FIG. 2*a*, 4*a*.

In one embodiment, the rear extension member 510 may pivot freely and independently of the actuator arm 280 carrying the slide actuator 230 and may lack a latched state. Thus, a user may grasp the rear extension member 510 in the position depicted in FIG. 5*a* and manually pivot the rear extension member 510 downward (FIG. 5*b*) or upward (FIG. 5*a*) whether or not the slide actuator 230 or the interior engagement form 120 is latched in position or not.

In another embodiment, the rear extension member 510 may be coupled to the actuator arm 280 of the slide actuator 230 at the distal end of the actuator arm 280 adjacent to the pivot 294 so that the rear extension member 510 and the actuator arm 280 pivot together.

For example, the rear extension member 510 may be coupled to the base 292 in a fixed manner in the position depicted in FIG. 5*b*, such that the rear extension member 510 does not pivot relative to the base 292 or to the expandable shoe interior engagement form 120. Other coupling techniques may be utilized, depending upon the particular application.

In the positions depicted in FIGS. 5*a* and 5*b*, the slide actuator 230 may remain in the rearward latched position as shown. Hence, the interior engagement form 120 may remain in the latched, contracted state in various positions of the arm 280 and extender member 510 depicted in FIGS. 5*a* and 5*b*. The slide actuator 230 may then be unlatched, slid forward to the forward latched position similar to that shown in FIG. 4*b* or 4*c* and relatched. When the slide actuator 230 is in the forward latched state, the interior engagement form 120 is actuated to a selected, expanded state.

Figure 6A:
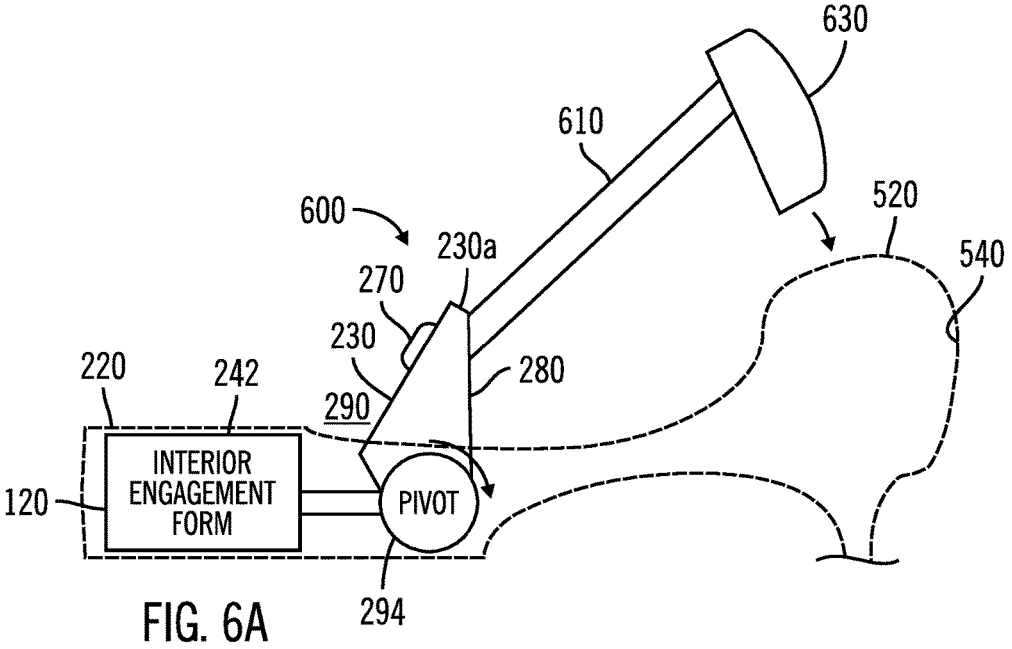
FIG. 6*a* is a side, schematic diagram, illustrating another shoe treatment device in accordance with another embodiment of the present description in which a rear extension member is depicted pivoted up out of a shoe while the expandable shoe interior engagement form is depicted inserted into the shoe.
Figure 6B:
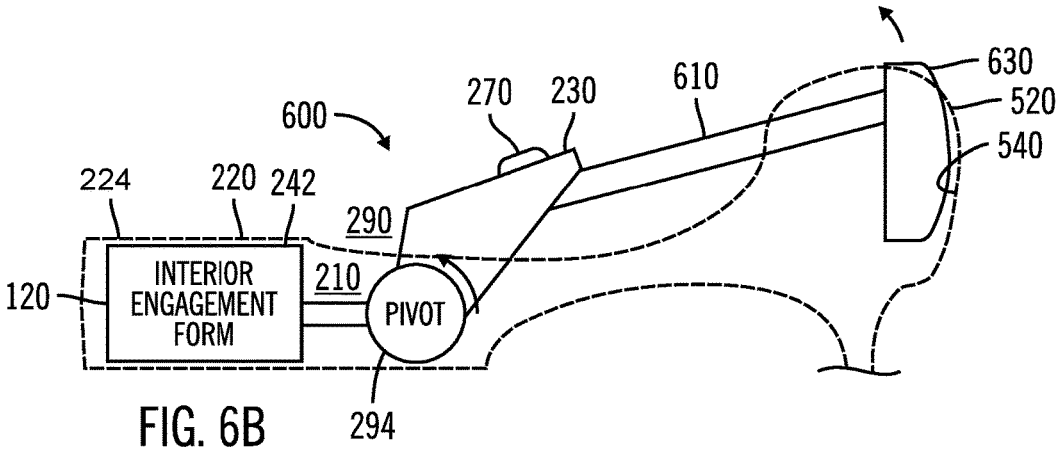
FIG. 6*b* is a side, schematic diagram, illustrating the shoe device of FIG. 6*a* in which the rear extension member is depicted pivoted down and into the interior of the shoe while the expandable shoe interior engagement form is depicted inserted into the shoe.

FIGS. 6*a*, 6*b* show another example of a shoe treatment device 600 having a rear extension member 610 which extends rearward from the arm 280 carrying the slide actuator 230 instead of from the base 292, toward the heel or counter 520 of a shoe 220. In the embodiment of FIGS. 6*a*, 6*b*, the rear extension member 610 is depicted as extending rearwardly from an upper end 230*a* of the actuator arm 280. It is appreciated that in other embodiments, the rear extension member 610 may extend from other portions of the arm 280, depending upon the particular application.

In one embodiment, the rear extension member 610 is fixed to the upper end 230*a* of the actuator arm 280 and thus does not pivot relative to the arm 280 carrying the slide actuator 230. The other end of the arm 280 is pivotally connected to the base 292 by the pivot 294. Thus, the arm 280 and the rear extension member 610, may be pivoted downward together from the position depicted in FIG. 6*a* until a counter interior engagement member 630 disposed on the distal end of the rear extension member 610 engages the counter interior 540 at the rear of the shoe interior 210. In this manner, the shape of the shoe 220 may be maintained by the shoe treatment device 600 while the shoe is being stored. Conversely, the arm 280 carrying the slide actuator 230 and the rear extension member 610 may be pivoted upward from the position depicted in FIG. 6*b* until the counter interior engagement member 630 disposed on the distal end of the rear extension member 610 no longer engages the counter interior 540 at the rear of the shoe interior 210. In this manner, the removal of the shoe treatment device 600 from the shoe 220 may be facilitated, particularly if the expandable shoe interior engagement form 120 has contracted to the smaller size of the contracted, stowed position of FIG. 2*a*, 4*a*.

In this embodiment, the rear extension member 610 is coupled directly to the arm 280 so that the rear extension member 610 and the arm 280 move together. Thus, to facilitate removal of the shoe treatment device 110 from the interior of the shoe 220, in another aspect of the present description, the user may grasp and pivot either or both of the arm 280 and the rear extension member 610 from the position depicted in FIG. 6*b*, back to an upright position such as that depicted in FIG. 6*a*.

In another embodiment, the rear extension member 610 may be pivotally coupled to the arm 280 carrying the slide actuator 230 so that the rear extension member 610 pivots freely relative to the arm 280. Thus, a user may grasp the rear extension member 610 in the position depicted in FIG. 6*a* and manually pivot the rear extension member 610 downward or upward whether or not the slide actuator 230 is latched in position or not or whether or not the interior engagement form 120 is in an expanded state or not. Thus, the rear extension member 610 may be pivoted downward from the position depicted in FIG. 6*a*, until the counter interior engagement member 630 disposed on the distal end of the rear extension member 610 is within the counter interior 540 at the rear of the shoe interior 210. The arm 280 carrying the slide actuator 230 may then be pivoted downward to the position depicted in FIG. 6*b*, causing the rear extension member 610 to engage the counter interior 540 at the rear of the shoe interior 210 as shown in FIG. 6*b*. In this manner, the arm 280 and the slide actuator 230 pivotally coupled to each other may form an over-center mechanical device to drive forward and rearward components of the shoe treatment device 600 in place within the interior of the shoe.

In the positions depicted in FIGS. 6*a* and 6*b*, the slide actuator 230 may remain in a rearward latched position as shown. Hence, the interior engagement form 120 may remain in the latched contracted state in the positions of the arm 280 and extender member 610 depicted in FIGS. 6*a* and 6*b*. The slide actuator 230 may then be unlatched, slid forward to the forward to a position similar to that shown in FIG. 4*b* or 4*c* and relatched. When the slide actuator 230 is in the forward latched state, the interior engagement form 120 is actuated to a latched, expanded state.

In accordance with another aspect of the present description, the rear extension members 510, 610 may be fixed in length. In other embodiments, the lengths of the rear extension members 510, 610 may be adjustable in length, depending upon the particular application.

Figure 7A:
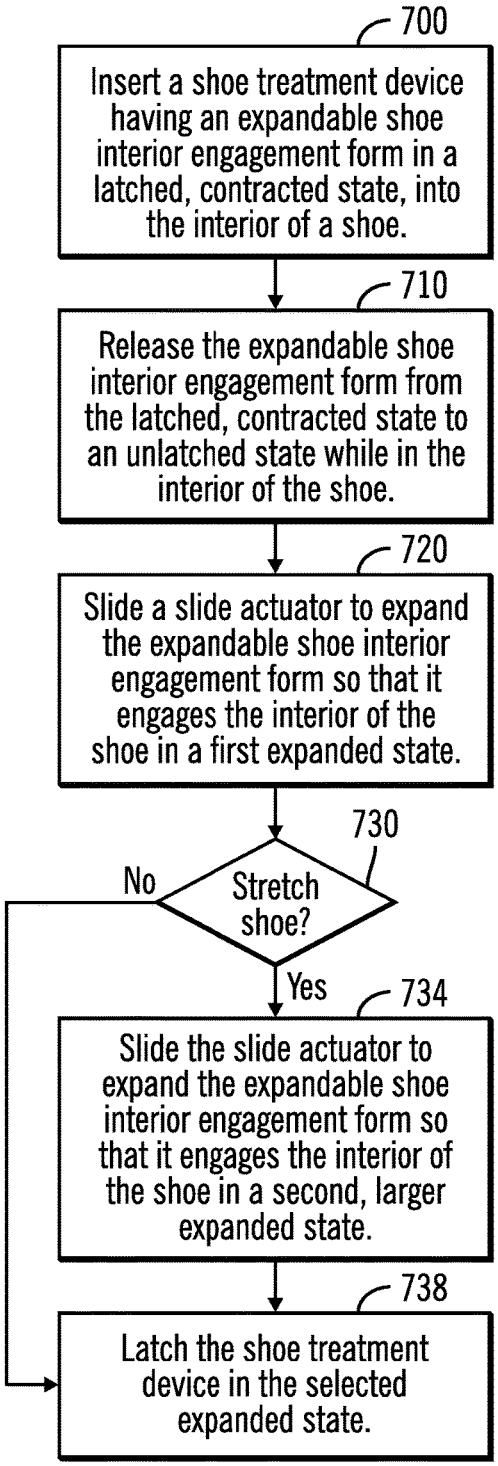
FIG. 7*a* depicts one example of operations in accordance with one aspect of the present description, utilizing a shoe treatment device in accordance with one embodiment of the present description.

FIG. 7*a* shows one embodiment of operations in accordance with one aspect of the present description. In one operation, a shoe treatment device having an expandable shoe interior engagement form is inserted (block 700) in a latched, contracted state, into the interior of a shoe.

In another operation, the expandable shoe interior engagement form is released (block 710) from the latched, contracted state, to an unlatched, state while in the interior of the shoe. In addition, a slide actuator such as the slide actuator 230 is slid (block 720) to expand the expandable shoe interior engagement form so that it engages the interior of the shoe in a first expanded state.

In one aspect of the present description, a first selected expanded state may represent a state suitable for shoe shape and size maintenance. In another aspect of the present description, the user may select (block 730) whether to stretch the shoe as well. If so, the user may slide (block 734) the slide actuator further to expand further the expandable shoe interior engagement form so that it engages the interior of the shoe in a second selected, larger expanded state, to stretch the shoe. The shoe treatment device may then be latched (block 738) in the selected expanded state.

Figure 7B:
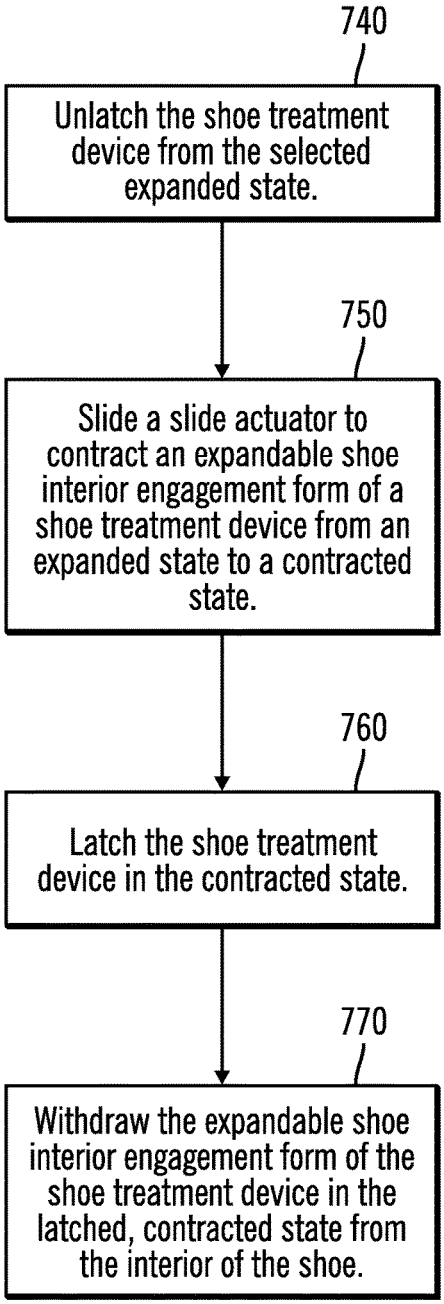
FIG. 7*b* depicts another example of operations in accordance with another aspect of the present description, utilizing a shoe treatment device in accordance with one embodiment of the present description.

FIG. 7*b* shows another example of operations in accordance with one aspect of the present description. In one operation, the shoe treatment device may be unlatched (block 740) from the selected expanded state. The user may further slide (block 750) the slide actuator to contract the expandable shoe interior engagement form of the shoe treatment device from the selected expanded state to a selected contracted state. In addition, the shoe treatment device may be latched (block 760) in the selected contracted state. Also, the expandable shoe interior engagement form of the shoe treatment device may be withdrawn (block 770) in the latched, contracted state from the interior of the shoe.

FIGS. 8*a*-8*c* and 9*a*-9*e* show one embodiment of the interior engagement form 120 in which the fabric enclosure 130 has been omitted for clarity. In this embodiment, the exterior shape of the arm 280 is elongated and rounded in cross-section. The arm 280 may be grasped with the user's hand with the user's fingers encircling the arm 280. The user's thumb may be placed upon the slide actuator button 270 and pointed toward the engagement form 120. The user's thumb may be used to slide the slide actuator button 270 selectively towards or away from the engagement form 120, to actuate the slide actuator 230. It is appreciated that other shapes of the arm 280 may be selected, depending upon the particular application.

Figure 8A:
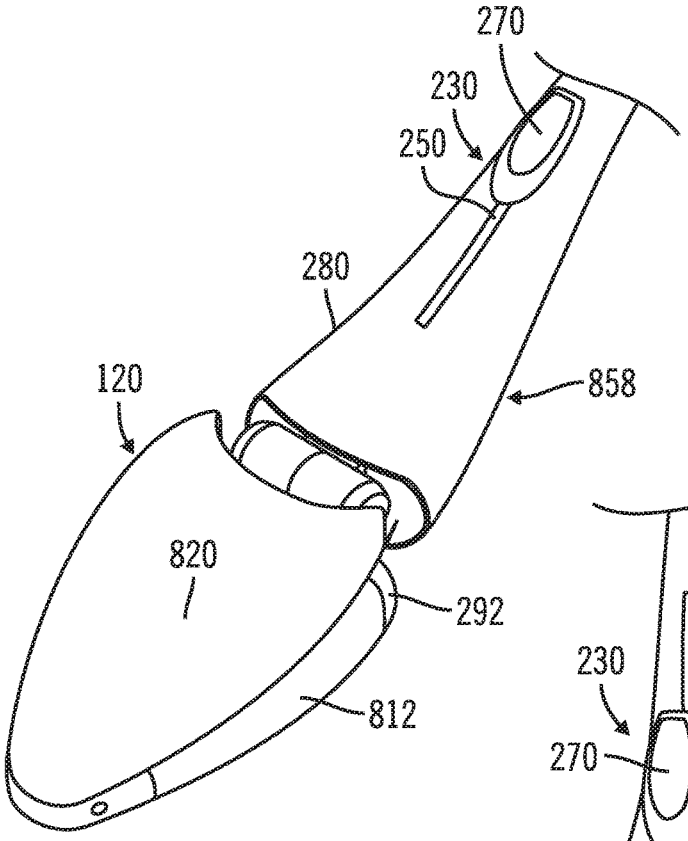
FIG. 8*a* is a top, front, perspective view of one embodiment of a shoe treatment device in accordance with one aspect of the present description depicting a slide actuator on a pivoting arm, and a shoe interior engagement form shown in a contracted state.
Figure 9A:
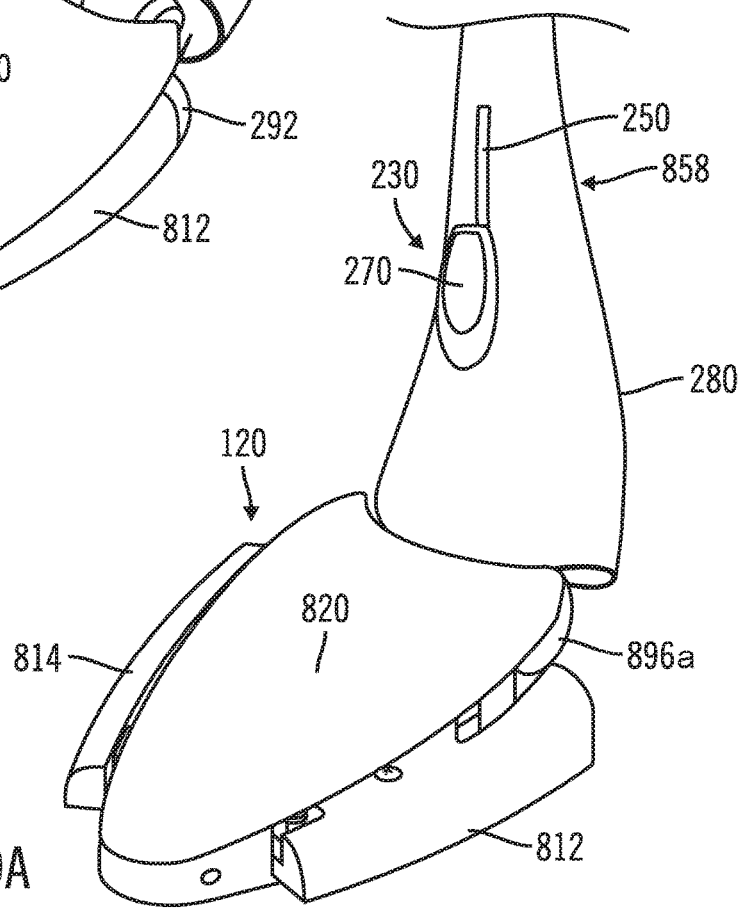
FIG. 9*a* is a top, front perspective view of the slide actuator and pivoting arm of FIG. 8*a*, and shoe interior engagement form of FIG. 8*a* shown in an expanded state.
Figure 8B:
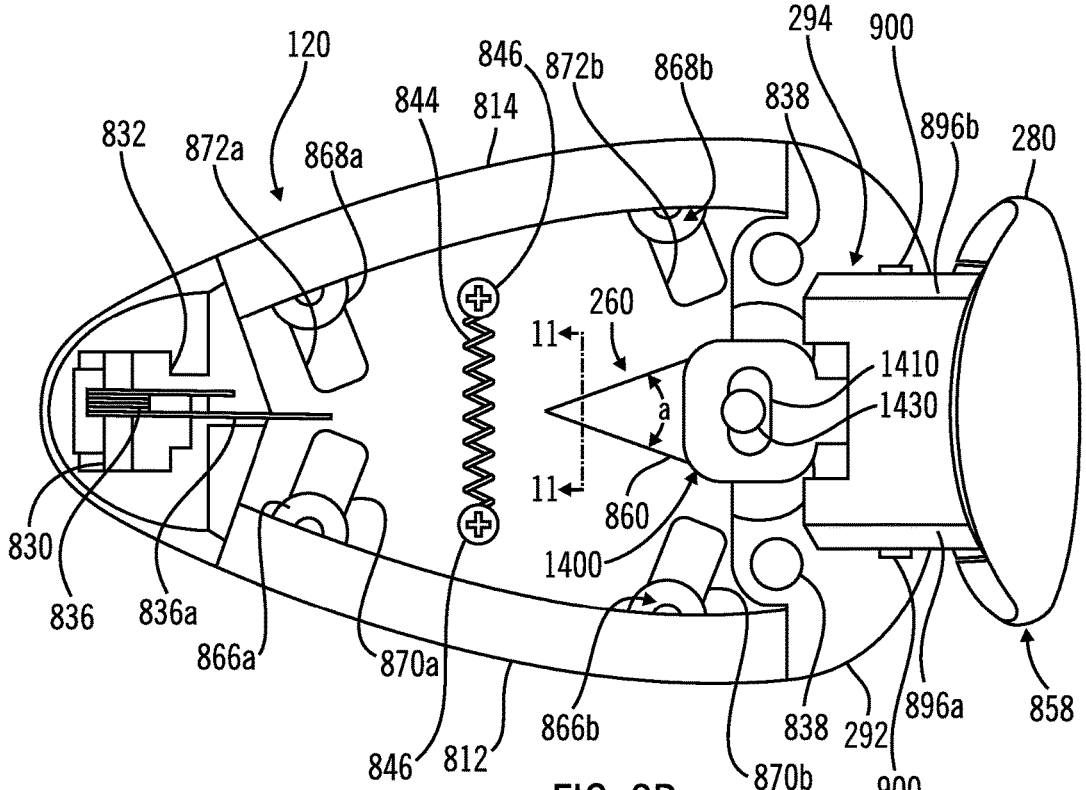
FIG. 8*b* is a top view of the shoe interior engagement form of FIG. 8*a* shown in a contracted state with a crown engagement member omitted, for clarity.
Figure 9B:
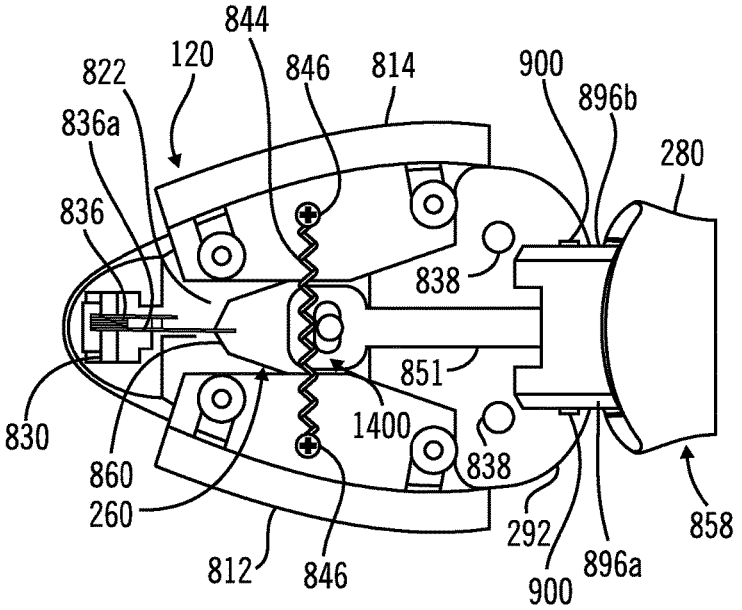
FIG. 9*b* is a top view of the shoe interior engagement form of FIG. 9*a* shown in an expanded state with a crown engagement member omitted, for clarity.
Figure 8C:
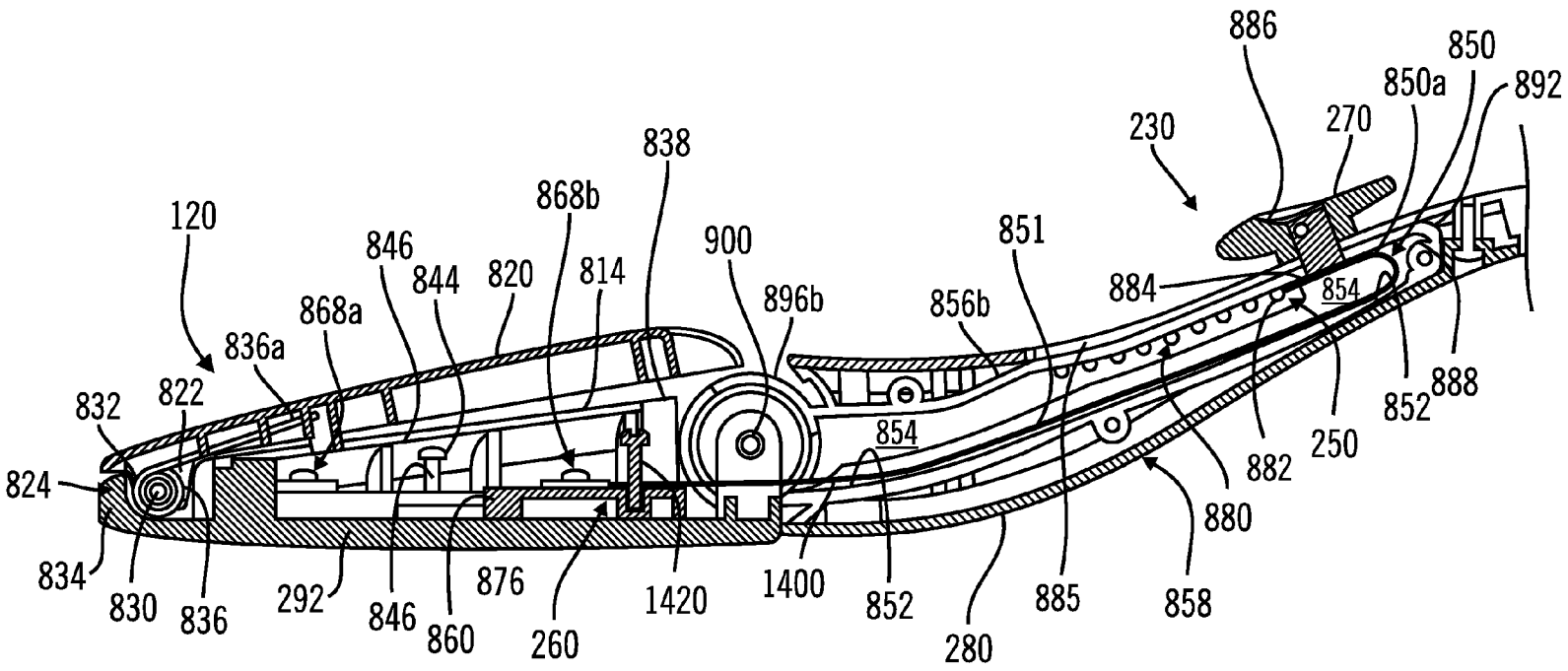
FIG. 8*c* is a side cross-sectional view of the pivoting slide actuator and shoe interior engagement form of FIG. 8*a* shown in a contracted state.

FIGS. 8*a*-8*c* depict the interior engagement form 120 in a latched, contracted state, with the arm 280 pivoted down to a lowered position. FIGS. 9*a*-9*e* depict the interior engagement form 120 in a latched, expanded state, and the arm 280 pivoted up to an upright position. FIG. 10 depicts various components of the shoe treatment device in an exploded view.

In the example of FIGS. 8*a*-8*c* and 9*a*-9*e*, the shoe interior engagement form 120 includes lateral wing engagement members 812, 814 movable between a contracted, stowed position as best seen in FIGS. 8*a*-8*c*, and a deployed, expanded position as depicted in FIGS. 9*a*-9*e*. The shoe interior engagement form 120 further includes a crown engagement member 820 movable between a contracted, stowed position depicted in FIGS. 8*a*, 8*c*, and a deployed, expanded position depicted in FIGS. 9*a* and 9*c*-9*e*.

The engagement members 812-820 are shaped such that when in their respective deployed positions, the shoe interior engagement form 120 in an expanded state is shaped generally to resemble that portion of a human foot which is within the toe box of the shoe 220 when worn. Thus, the shoe interior engagement form 120 of the shoe treatment device 110*a* (FIG. 1) may be shaped generally to resemble that portion of a right human foot which is within the toe box of a right shoe 220 when worn. Similarly, the shoe interior engagement form 120 of the shoe treatment device 110*b* (FIG. 1) may be shaped generally to resemble that portion of a left human foot which is within the toe box of a left shoe 220 when worn. It is appreciated that the shoe interior engagement form 120 may be shaped to have other shapes in one or more expanded states, depending upon the particular application.

The engagement members 812-820 may be made of any suitable material. For example, the engagement members 812-820 may be made of cedar or other moisture and odor absorbing materials. Other materials such as plastic may be used, depending upon the particular application.

The crown member 820 has a pair of forward positioned flanges 822 (FIGS. 8*c*, 9*c*, 10) which are pivotally connected to the base 292 by a pivot pin 830 of a pivot 824 positioned at the front of the base 292. The forward flanges 822 are received in a corresponding opening 832 (FIG. 10) defined by a nose member 834 of the base 292 and positioned at the front of the base 292. In this manner, the crown member 820 pivots vertically between the stowed position depicted in FIGS. 8*a*, 8*c* and the deployed position depicted in FIGS. 9*a*, 9*c*. In one embodiment, flanges 822 may be received in corresponding guide slots (not shown) of the base nose member 834 to guide the vertical motion of the crown member 820 to limit lateral motion of the crown member 820 in that embodiment. It is appreciated however that a degree of lateral motion of a crown member may be appropriate in some embodiments.

In the illustrated embodiment, the interior engagement form 120 includes a torsion spring 836 (FIGS. 8*b*, 8*c*, 9*b*, 9*c*) of the biasing device 296 (FIG. 2*a*). The torsion spring 836 is carried by the pivot pin 830 and includes an engagement member 836*a* engaging the underside of the crown engagement member 820 to bias the crown engagement member 820 from the stowed, contracted position depicted in FIG. 8*c*, and to the deployed, expanded position depicted in FIGS. 9*c* and 9*d*. Contraction of the crown engagement member 820 is limited by a pair of posts 838 extending from the base 292 which are positioned to engage the underside of the crown engagement member 820 to inhibit excessive contraction in the stowed, contracted position depicted in FIG. 8*c*. In another embodiment, springs such as coil springs may be added to or substituted for the torsion spring 836. For example, in one embodiment, the coil springs may be secured at one end by a corresponding post of the pair of posts 838 extending from the base 292. The other end of such a coil spring may be secured to the underside of the crown engagement member 820 by suitable fasteners or female cavities of the crown engagement member 820, which may be positioned to receive the upper ends of the coil springs.

In one embodiment, the crown engagement member 820 is not latched and is not actuated by the slide actuator 230. Instead, in this embodiment the crown engagement member 820 is free to be compressed in an expanded state as the user inserts the interior engagement form 120 into the toe box area of the shoe. The torsion spring 836 further continues to apply a bias force to the crown member 820 in a deployed state. As a consequence, the interior engagement form 120 applies pressure to the upper portion of the interior 210 of the shoe toe box area 224, to shape the shoe toe box area 224, particularly in the upper portion of the toe box area 224.

It is appreciated that in some embodiments, the crown engagement member may be latched in one or more of a contracted or stowed position and a deployed or expanded position. It is further appreciated that in some embodiments, the crown engagement member may be actuated by a suitable actuator to actuate the crown engagement member to or from, as appropriate, a contracted or stowed position or a deployed or expanded position.

As best seen in FIG. 10, the base 292 includes a generally flat platform 840 having a supporting slide surface 842 which supports the wing engagement members 812, 814 for sliding motion between the stowed, contracted position depicted in FIGS. 8*a*-8*c*, and the deployed, expanded position depicted in FIGS. 9*a*-9*e*. In the illustrated embodiment, the slide actuator 230 coupled to the expander 260 (FIGS. 2*b*, 8*b*, 9*b*), actuates the expander 260 to drive the wing engagement members 812, 814 (FIG. 10) apart in one or more directions generally parallel to the plane of the supporting slide surface 842 of the platform 840 of the base 292. Although, the wing engagement members 812-814 of the illustrated embodiment are configured for sliding motion in a primarily lateral direction, it is appreciated that the wing engagement members may be configured for other types of engagement motion including pivoting motions or vertical motions, for example.

In the illustrated embodiment, the engagement members 812-820 do not engage the interior 210 of the shoe directly. Instead, the outer surface 242 (FIG. 2*a*) of the expandable shoe interior engagement form 120 includes a fabric shroud 130 (FIG. 1) which covers the crown member 820 and the lateral wing members 812, 814 of the shoe interior engagement form 120. In one embodiment, the fabric shroud 130 may be made of a moisture and odor absorbing fabric such as an anti-microbial fabric. It is appreciated that in other embodiments, the fabric shroud may be made of other materials, including foam inserts encasing the engagement members, depending upon the particular application. In addition, in other embodiments, the engagement members 812-820 may engage the interior 210 of the shoe directly, such that a shroud 130 may be omitted.

In the illustrated embodiment, the wing engagement members 812, 814 of the expandable shoe interior engagement form 120 are biased by the biasing device 296 (FIGS. 2*a*-2*c*, 8*b*, 9*b*) to contract to a contracted state. The biasing device 296 may utilize any device which can provide a suitable biasing force to the wing engagement members 812, 814 of the expandable shoe interior engagement form 120. For example, the biasing device 296 may include a coil type spring 844 (FIGS. 8*b*, 9*b*,10) fastened by a fastener 846 (FIG. 8*b*) at one end to the wing engagement member 812, and fastened by a similar fastener at the other end of the coil spring 844 to the other wing engagement member 814. As the slide actuator 230 is actuated in a reverse direction (toward the heel of the shoe), the expander 260 is corresponding withdrawn in the reverse direction, allowing the wing engagement members 812, 814 to close inwardly back towards each other and towards the stowed, contracted position depicted in FIG. 8*b* under the biasing force provided by the coil spring 844.

In the illustrated embodiment, the torsion spring 836 biasing the crown engagement member 820 and the coil spring 844 biasing the wing engagement members 812, 814 operate independently of each other so as to provide biasing forces to the crown member 820, and the lateral wing members 812, 814 independently of each other. It is believed that such an arrangement facilitates the expandable toe box interior engagement form 120 adapting to a variety of toe box shapes and sizes. It is appreciated that in other embodiments, the biasing members of the biasing device 296 may be configured to be operate in a more cooperative fashion, depending upon the particular application.

Figure 9C:
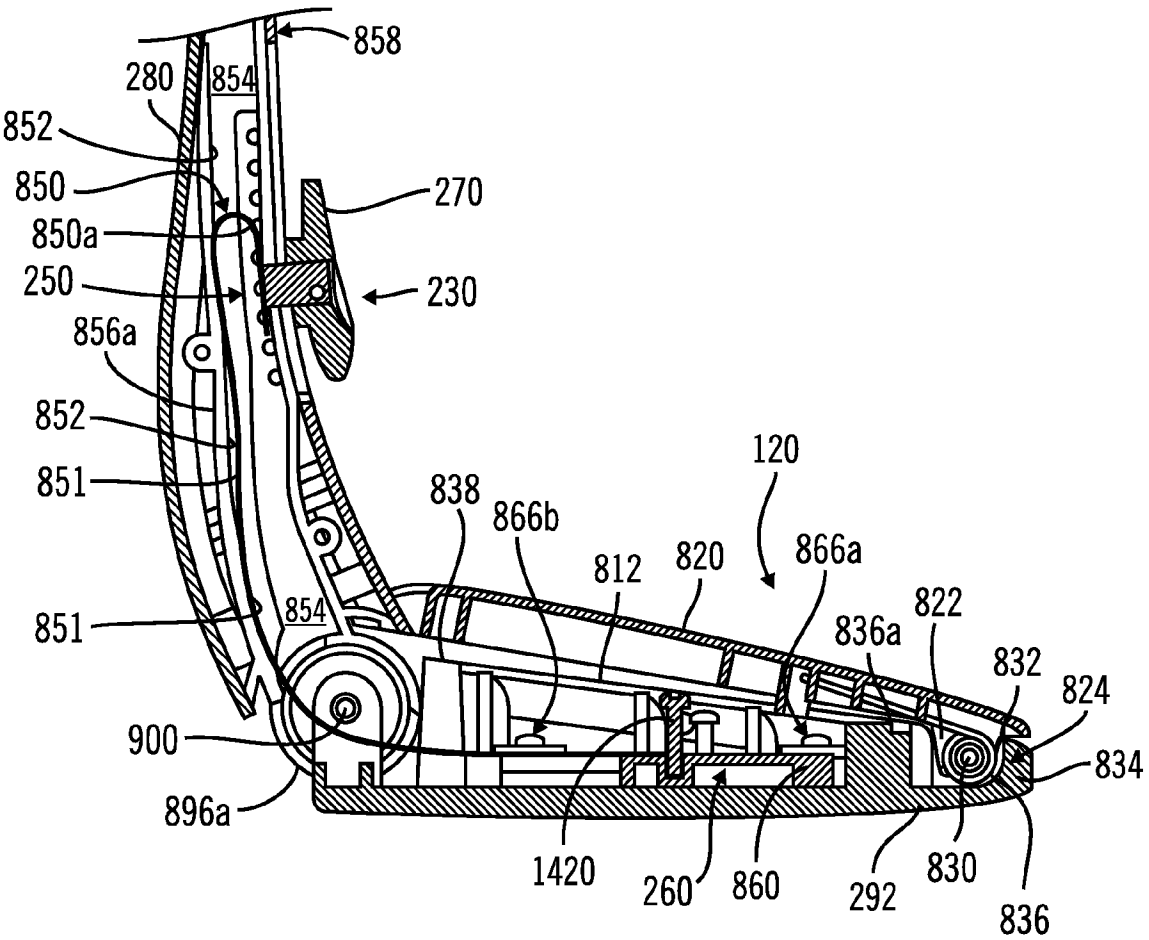
FIG. 9*c* is a side cross-sectional view of the slide actuator and pivoting arm of FIG. 9*a*, and the shoe interior engagement form of FIG. 9*a* shown in an expanded state.
Figure 9D:
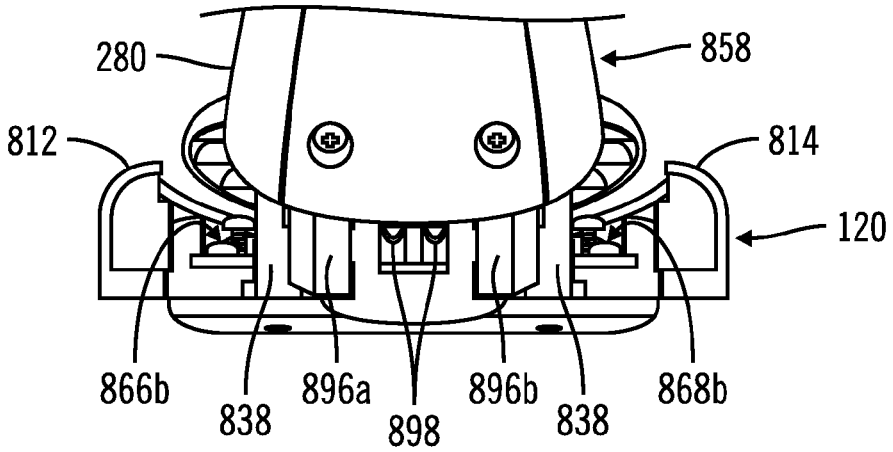
FIG. 9*d* is a rear view of the shoe interior engagement form of FIG. 9*a* shown in an expanded state.
Figure 9E:
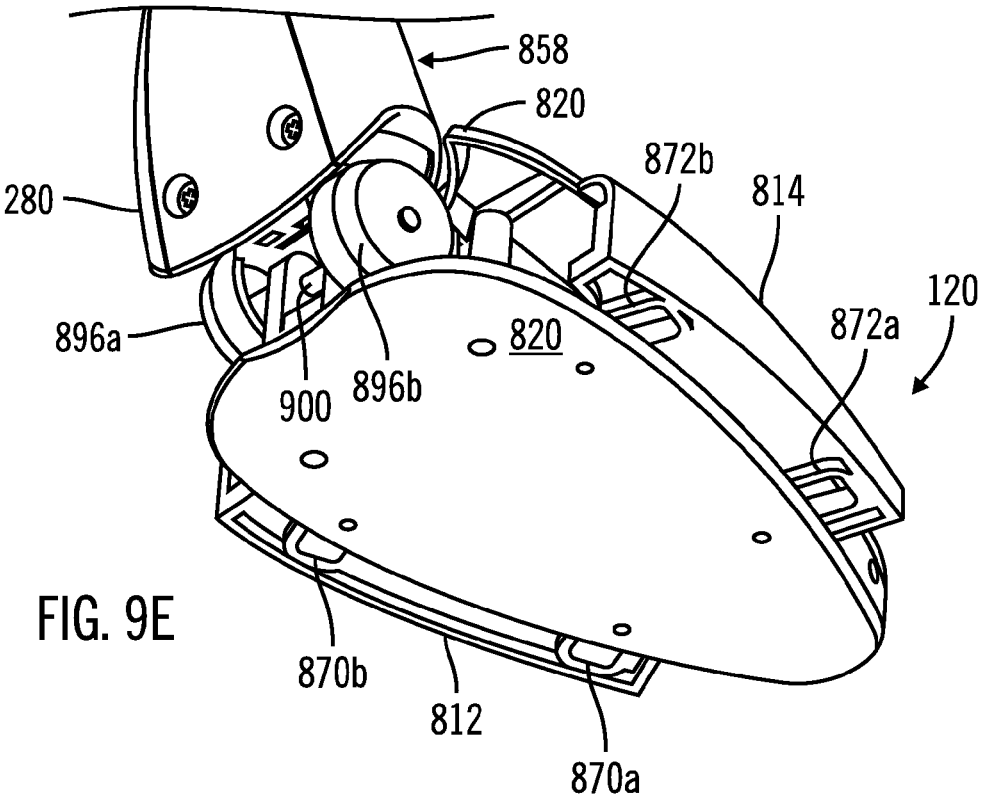
FIG. 9*e* is a bottom, rear perspective view of the shoe interior engagement form of FIG. 9*a* shown in an expanded state.
Figure 10:
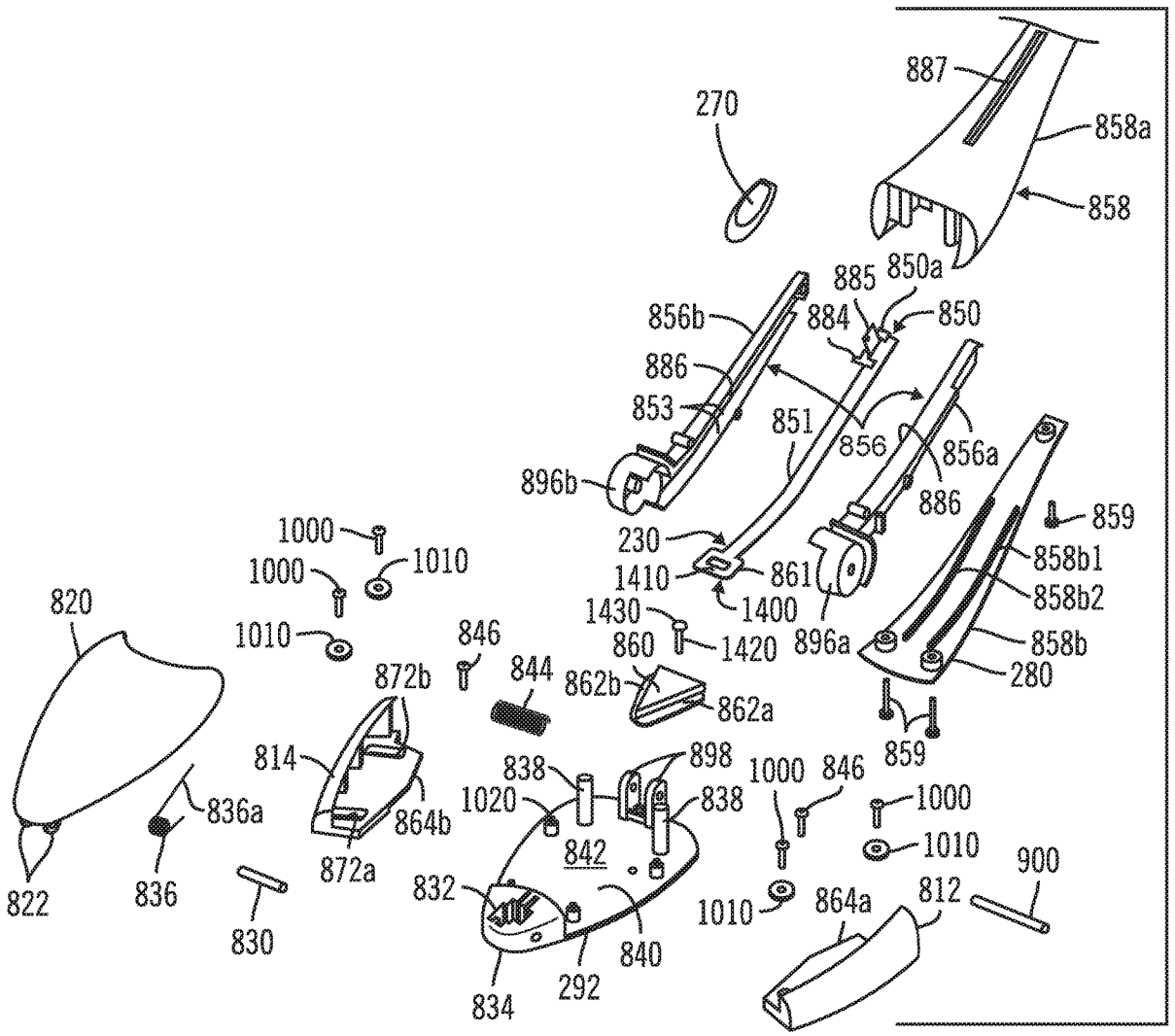
FIG. 10 is an exploded view of one embodiment of components of a shoe treatment device in accordance with one aspect of the present description.

FIGS. 8*c*, 9*c*, and 10 show one embodiment of the slide actuator 230 which includes a sled member 850 (FIGS. 8*c*, 9*c* and 10) which slides along a slot or guide track 852 within the arm 280. The guide track 852 is defined by a recess 854 (FIG. 13A) of an actuator housing assembly which includes housing components 856*a*, 856*b* within the actuator arm 280. The sled member 850 is coupled to the user actuated knob 270 which the user selectively pushes or pulls along the guide track 852 to drive the sled member 850 forward toward the expander 260 of the interior engagement form 120, or rearward away from the expander 260, respectively. The actuator housing assembly 856 is assembled from the housing components 856*a*, 856*b* which are joined together with suitable fasteners. The components 856*a*, 856*b* of the actuator housing assembly are received within an outer housing assembly 858 of the actuator arm 280. The outer housing assembly 858 is assembled from housing components 858*a*, 858*b* which are joined together with suitable fasteners 859. The actuator housing assembly may be nested within spaced rails 858*b*1, 858*b*2 (FIG. 10) of the housing component 858*b*.

The sled member 850 of the slide actuator 230 is coupled by a link member 851 (FIGS. 8*c*, 9*c* and 10) to the expander 260 of the interior engagement form 120. In the illustrated embodiment, the sled member 850 includes a leaf spring 850*a* which is integrally formed from one end of the link member 851 which is curved back upon the link member 851 to form the integral, C-shaped, ribbon-shaped leaf spring 850*a*. It is appreciated that in other embodiments, a sled member or a spring may be formed separately and affixed to the link member 851. The link member 851 passes through the guide track 852 of the actuator housing assembly 856 and thus moves along the arm 280. As best seen in FIG. 10, the guide track 852 includes a generally tubular enclosure 853 which encloses a portion of the guide track 852 through which the link member 85*a* passes. The guide track 852 guides the sled member 850 and the link member 851 which functions as a push rod as the sled member 850 is pushed forward along the guide track 852 toward the expander 260 and hence the toe box 224 of the shoe.

Conversely, the link member 851 functions as a pull rod as the sled member 850 is pulled rearward along the guide track 852 away from the expander 260, and hence away from the toe box 224 of the shoe. In the illustrated embodiment, the link member 851 is sufficiently flexible to accommodate the pivotal motion between the actuator arm 280 and the platform 840 of the base 292. For example, it is believed that a relatively flat, ribbon-shaped link member 851 provides sufficient flexibility to bend in the pivot direction of the arm 280 in a range of approximately 90 degrees, as the arm moves between the upright (FIG. 9*c*) and lowered positions (FIG. 8*c*). For example, in one embodiment, the link member 851 is bent in an approximately 100 degree angle when the arm 280 is pivoted up to the upright position (FIG. 9*c*) and is bent in an approximately 170 degree angle when the arm 280 is pivoted downward to the lowered position (FIG. 8*c*) and may be bent in each angle therebetween.

Further, the link member 85*a* is sufficiently resistant to compression by the sliding sled member 850 when the link member 851 is used in the push rod mode, and is sufficiently resistant to stretching when used in the pull rod mode. In one embodiment, the link member 851 and the integral leaf spring 850*a* are formed of flexible spring steel. In one embodiment, a suitable lubricant may be applied to the link member 851 or to the guide track 852, or both, to facilitate the sliding motion of the link member 851 within the guide track 852. It is appreciated that other shapes and a variety of materials may be utilized, depending upon the particular application.

In the illustrated embodiment, the expander 260 of the interior engagement form 120 includes an expander member 860 which as best seen in FIG. 10 is generally flat and wedge-shaped. The expander member 860 is coupled to the distal end 861 of the link member 851 and is supported by the platform 840 of the base 292. The expander member 860 slides over the supporting surface 842 of the platform 840 in response to the push motion provided by the link member 851. As the expander member 860 slides forward in response to the push motion provided by the link member 851, the expander member 860 engages one or more movable engagement members 812, 814 of the shoe interior engagement form 120 to move engagement members 812, 814 forward and outwardly from the contracted state of FIG. 8*b*, to an expanded state depicted in FIG. 9*b*. The link member 851 may push the expander member 860 forward or pull the expander member 860 back, in response to the user's actuation of the actuator button 270, whether the arm 280 is pivoted up to the upright position such that the link member 851 is bent in an approximately 100 degree angle, or the arm 280 is pivoted downward to the lowered position such that the link member 85*a* is bent in an approximately 170 degree angle, or the arm 280 is pivoted to an intermediate position between the positions depicted in FIGS. 8*c* and 9*c*.

Figure 11:
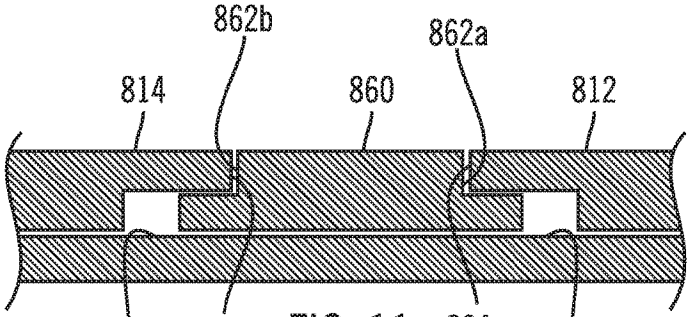
FIG. 11 is a partial cross-sectional view of an expander member and wing engagement members of the shoe interior engagement form of FIG. 8*b* as viewed along the lines 11-11.

The expander member 860 has a pair of recessed inclined engagement surfaces 862*a*, 862*b* (FIG. 10) which are angled relative to each other as the sides of an isosceles triangle, in the illustrated embodiment. As best seen in the cross-sectional schematic diagram of FIG. 11, the inclined engagement surfaces 862*a*, 862*b* (FIG. 10) of the expander member 860 are defined by extending flanges and slidingly engage corresponding inclined engagement surfaces 864*a*, 864*b* (FIG. 10) of extending flanges of the wing engagement members 812, 814, respectively so that the flanges of the expander member 860 and the engagement members 812, 814 are interdigitated as shown in FIG. 11. It is believed that positioning the flanges of the extender member 860 between the flanges of the members 812, 814 and the platform surface 842 facilitates guiding the motion of the expander member 860 in a horizontal direction.

In the illustrated embodiment, the expander member inclined engagement surfaces 862*a*, 862*b* are inclined relative to each other at an angle of 40 degrees. It is appreciated that other angles may be suitable such as an angle in the range of 30-90 degrees, for example, depending upon the particular application. In some embodiments, the more narrow the angle between the engagement surfaces of the expander, the greater the travel of the expander for a given amount of expansion of the wing engagement members. Conversely, the more wide the angle between the engagement surfaces of the expander, the less the expander travels for a given amount of expansion of the wing engagement members. Although the expander member 860 is depicted as a symmetrical, wedge-shaped member, it is appreciated that other shapes including curved or nonsymmetrical, for example, may be appropriate, again, depending upon the particular application.

In the illustrated embodiment, as best seen in FIGS. 8*c*, 9*c*, the latch 250 is a ratchet latch which includes an internal rack 880 which is integrally formed within the recess 854 of the actuator housing assembly components 856*a*, 856*b*. The rack 880 has parallel rows of spaced ratchet teeth 882, one row in each housing component 856*a*, 856*b*, which cooperate with a flexible pawl 884 extending from the leaf spring 850*a* of the sled member 850. The upper surface of the pawl 884 is coupled by a tab member 885 to the user manipulatable knob 270 of the slide actuator 230. The rack 880 defines a central guide slot 886 (FIG. 10) through which the tab member 885 of the sled member 850 of the slide actuator 230 extends (FIG. 8*c*). The tab member 885 also extends through a central guide slot 887 of the housing component 858*a* of the outer housing assembly 858 of the arm 280. In the illustrated embodiment, longitudinal traversal of the sled member 850 through the arm 280 is guided by the guide track 852 as well as the tubular enclosure 853 which limit lateral movement of the sled member 850. It is appreciated that such limits may vary or be eliminated in other embodiments, depending upon the particular application.

The pawl 884 is integrally formed extending from the leaf spring 850*a* of the sled member 850 of the slide actuator 230. It is appreciated that in other embodiments, a rack, spring, pawl and other components of the latch 250 may be fabricated separately and affixed to the latch 250 of the actuator arm 280. It is further appreciated that other types of mechanisms may provide a suitable latch. Moreover, it is appreciated that in some embodiments of a shoe treatment device in accordance with the present description, a latch may be omitted.

FIG. 8*c* depicts the latch 250 in a latched position in which the pawl 884 engages one of the teeth 882 of the rack 880. The latch 250 may be unlatched by the user depressing the knob 270 to flex the leaf spring 850*a* of the sled member 850 and push the pawl 884 away from and out of engagement which the teeth 882 of the rack 880.

In the illustrated embodiment, as best seen in FIGS. 8*b*, 9*b*-9*e* and 10, the pivot 294 pivotally coupling the actuator arm 280 to the base 292 includes a pair of outer hinge members 896*a*, 896*b* which, in the illustrated embodiment, are integrally formed with and extend from the distal end of the actuator housing components 856*a*, 856*b*, respectively. The pivot 294 further includes a pair of inner hinge members 898 extending from the base 292 and received between the outer hinge members 896*a*, 896*b*. A pivot pin 900 extends through the pairs of hinge members 896*a*, 896*b*, 898 pivotally coupling the hinge members 896*a*, 896*b*, 898 and hence the actuator arm 280 and base 292.

As noted above, the slide surface 842 of the platform 840 supports the wing engagement members 812, 814 for horizontal sliding motion between the stowed, contracted position depicted in FIGS. 8*a*-8*c*, and the deployed, expanded position depicted in FIGS. 9*a*-9*e*. In the illustrated embodiment, the sliding motions of the wing engagement members 812, 814 are independently guided by guide pins 866*a*, 866*b* and 868*a*, 868*b* (FIG. 8*b*) for the wing engagement members 812, 814, respectively. The guide pins 866*a*, 866*b* and 868*a*, 868*b* are fastened to the slide surface 842 of the platform 840 and are received by guide slots 870*a*, 870*b* and 872*a*, 872*b* respectively, for the wing engagement members 812, 814, respectively. The guide pins 866*a*, 866*b* and 868*a*, 868*b* each include a fastener 1000 which passes through a collar 1010 and is threadably received by a guide pin base 1020 integrally formed to extend from the slide surface 842 of the base 292. The collar 1010 has a diameter of sufficient size to retain the associated guide pin 866*a*, 866*b* and 868*a*, 868*b* in the associated guide slot 870*a*, 870*b* and 872*a*, 872*b*.

Figure 12A:
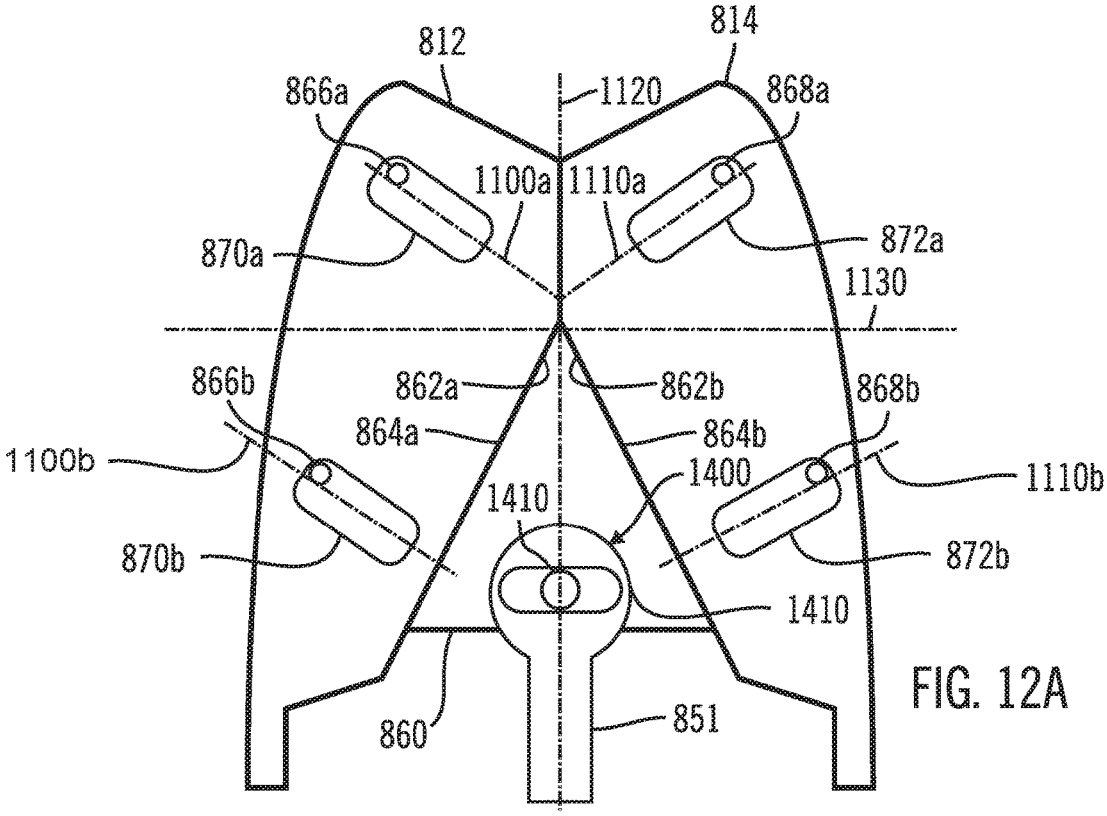
FIG. 12*a* is a top view schematic diagram of an expander member and lateral wing engagement members of a shoe interior engagement form in accordance with one embodiment of the present description, depicted in a lateral contracted state.
Figure 12B:
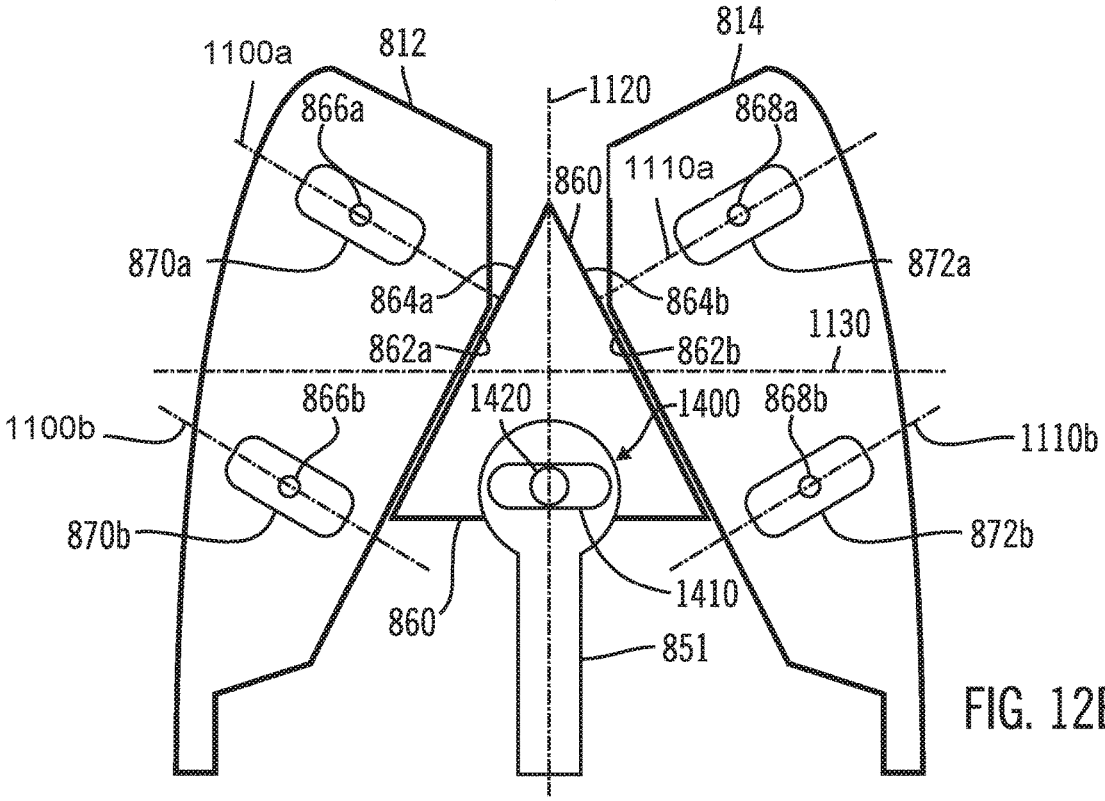
FIG. 12*b* is a top view schematic diagram of the expander member and lateral wing engagement members of FIG. 12*a*, depicted in a symmetrically displaced, lateral expanded state.
Figure 12C:
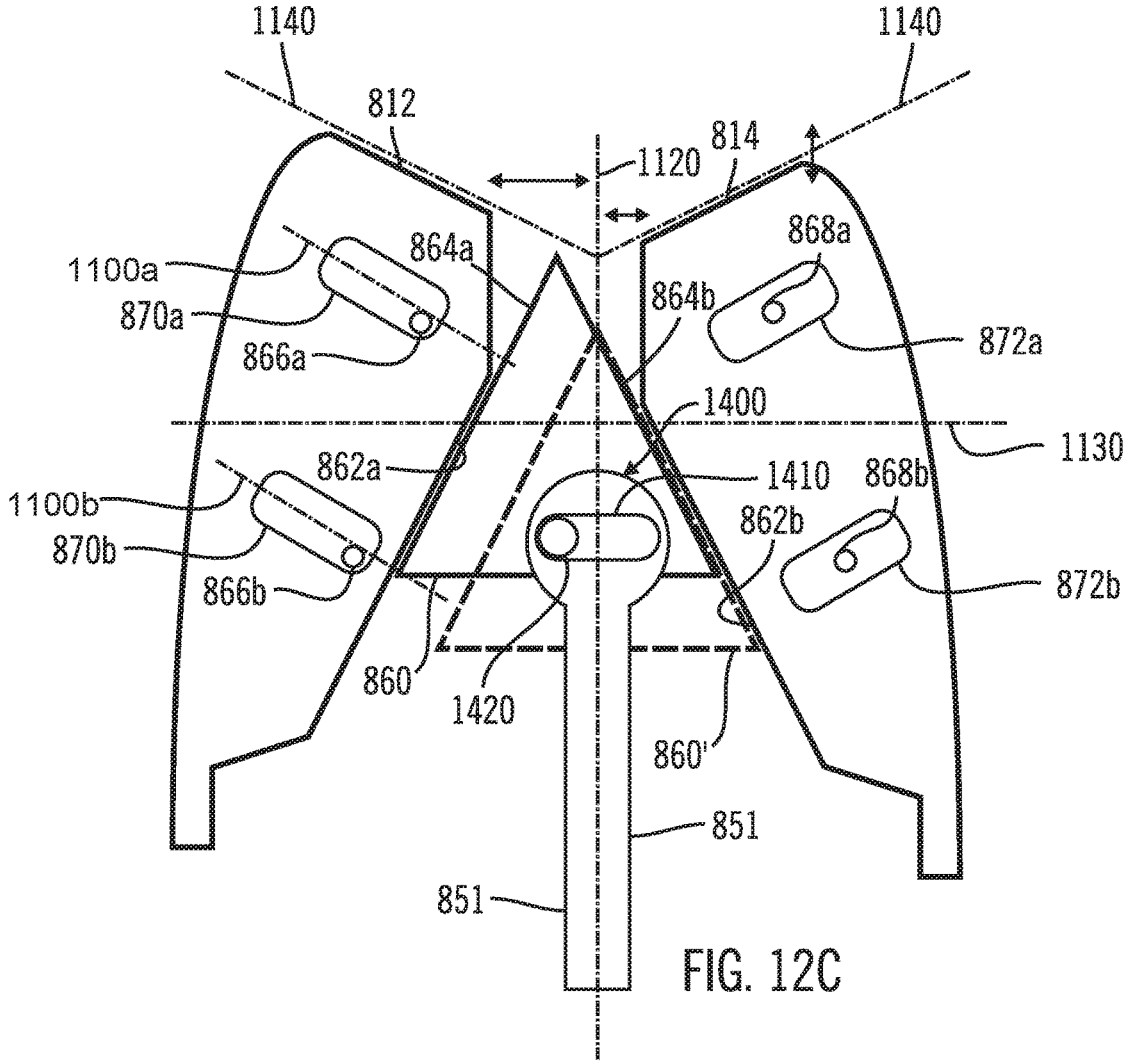
FIG. 12*c* is a top view schematic diagram of the expander member and lateral wing engagement members of FIG. 12*a*, depicted in an asymmetrically displaced, lateral expanded state.

As best seen in the schematic diagrams of FIGS. 12*a*-12*c*, the guide slots 870*a*, 870*b* are longitudinal in shape and generally parallel to each other with the longitudinal axis 1100*a*, 1100*b* of each of the guide slots 870*a*, 870*b* being oriented generally parallel to each other and orthogonal to the inclined engagement surface 862*a* of the expander member 860 and the inclined engagement surface 864*a* of the wing engagement member 812. Similarly, the guide slots 872*a*, 872*b* are longitudinal in shape with the longitudinal axis 1110*a*, 1110*b* of each of the guide slots 872*a*, 872*b* being oriented generally parallel to each other and orthogonal to the inclined engagement surface 862*b* of the expander member 860 and the inclined engagement surface 864*b* of the wing engagement member 814. Accordingly, the wing engagement members are generally directed for movement in a direction defined by the guide slot longitudinal axes 1100*a*, 1100*b*, 1110*a*, 1110*b*.

The shoe treatment device 110 defines a longitudinal axis 1120 which corresponds generally with the longitudinal axis of the shoe when the device 110 is inserted into the shoe. Hence, the longitudinal axis 1120 corresponds generally to the toe to heel direction of the shoe. Orthogonal to the longitudinal axis 1120 is a transverse axis 1130 corresponding generally to the left-right direction of the shoe. In the illustrated embodiment, the orientation of the longitudinal axis 1100*a*, 1100*b*, 1110*a*, 1110*b* of each of the guide slots 870*a*, 870*b* and 872*a*, 872*b*, respectively is angled at approximately 70 degrees with respect to the longitudinal axis 1120 of the shoe treatment device 110. As a result, the longitudinal axis 1100*a*, 1100*b*, 1110*a*, 1110*b* of each of the guide slots 870*a*, 870*b* and 872*a*, 872*b*, respectively, is substantially orthogonal to the respective engagement surfaces 862*a*, 862*b* of the expander member 860. Accordingly, the lateral movement of each wing engagement member 812, 814 may include both a forward-reverse direction component parallel to the device longitudinal axis 1120 and a side to side direction component parallel to the device transverse axis 1120. It is appreciated however that the longitudinal axes 1100*a*, 1100*b*, 1110*a*, 1110*b* of the guide slots 870*a*, 870*b* and 872*a*, 872*b* may be angled at other angles such as angles in a range of 10-90 degrees, for example. Other angles may be suitable, depending upon the particular application.

Figure 12D:
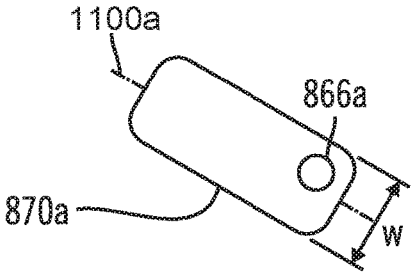
FIG. 12*d* is a top view schematic of a guide slot of a wing engagement member of FIG. 12*a*.

Although the wing engagement members are generally directed for lateral movement in a direction defined by the associated guide slot longitudinal axes 1100*a*, 1100*b*, 1110*a*, 1110*b*, in accordance with another aspect of the present description, the width "w" of each guide slot 870*a*, 870*b* and 872*a*, 872*b* is substantially larger than the diameter of the associated guide pin 866*a*, 866*b* and 868*a*, 868*b* as shown in FIG. 12*d* for the guide slot 870*a*, for example. As a consequence, the wing engagement members 812, 814 have a degree of independent freedom of movement which permits the wing engagement members 812, 814 to move laterally independently of each other.

For example, schematic diagram FIG. 12*a* depicts the wing engagement members 812, 814 in a stowed, contracted position. This stowed, contracted position of the wing engagement members 812, 814 may correspond to a first position 1300 of the user-manipulatable knob 270 of the slide actuator 230 as shown in FIG. 13*a*. In the first position 1300, the pawl 884 of the slide actuator 230 is in the latched position, engaging teeth 882 of the rack 880 as shown in the top schematic cross-sectional diagram of FIG. 13*c*.

Figure 13B:
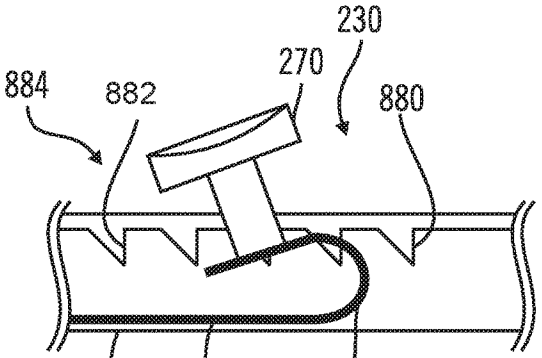
FIG. 13*b* is a partial side view schematic diagram of the slide actuator of FIG. 13*a* depicted in an unlatched position.
Figure 13A:
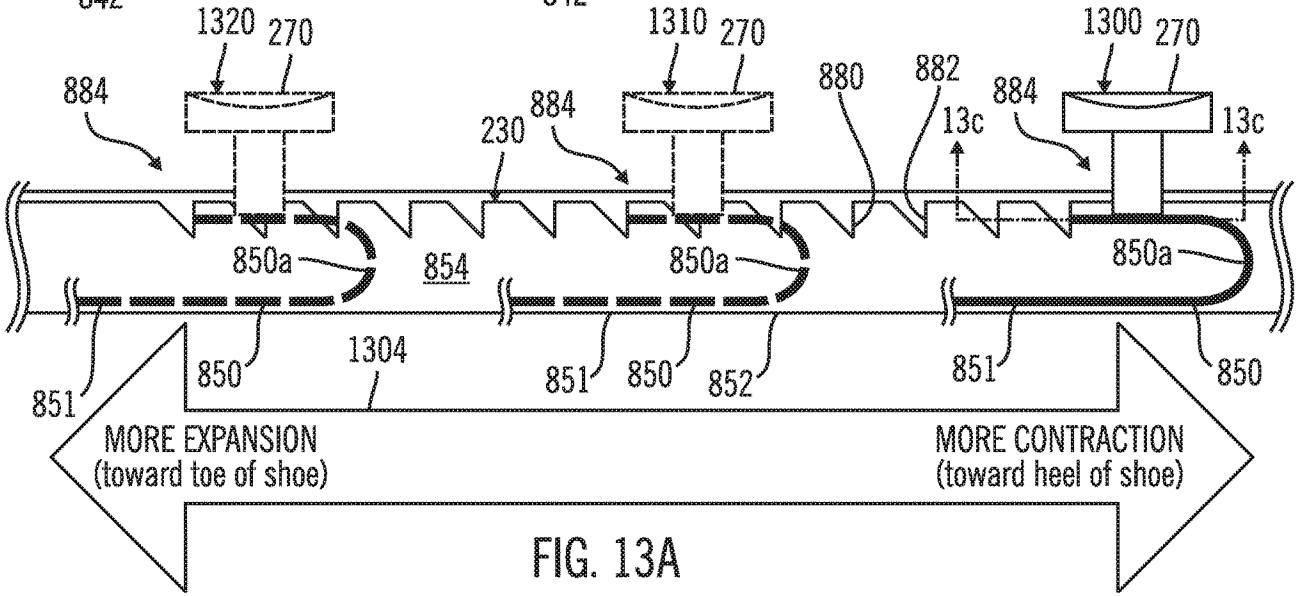
FIG. 13*a* is a partial side view schematic diagram of a slide actuator for a shoe interior engagement form in accordance with one embodiment of the present description, depicted in various positions, each position corresponding to an associated latched, expanded or contracted state of the shoe interior engagement form.
Figure 13C:
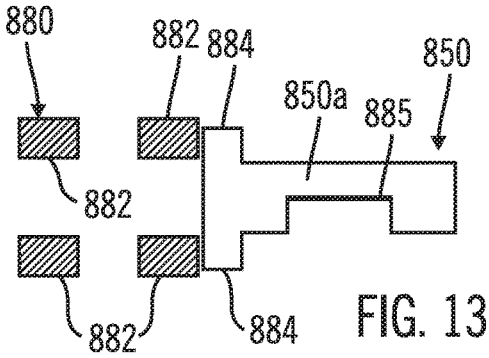
FIG. 13*c* is a top schematic cross-sectional diagram of the slide actuator of FIG. 13*a* in a latched position as viewed along the lines 13*c*-13*c* of FIG. 13*a*.

The user may then engage the user manipulatable knob 270, using the user's thumb, for example, to pivot the knob 270 as shown in FIG. 13*b* and to contract the leaf spring 850*a*, so that the pawl 884 disengages from the rack 880 to unlatch the slide actuator 230. In the unlatched position, the user may push the knob 270 toward the front of the shoe treatment device. As indicated by the arrow 1304, pushing the knob 270 of the slide actuator 230 toward the front of the shoe treatment device causes the interior engagement form 120 (FIG. 2*a*) to expand. In general, the farther forward the knob 270 is pushed toward the front of the shoe treatment device, the greater the degree of expansion of the interior engagement form 120 as indicated by the arrow 1304.

Once the slide actuator reaches a desired position, the slide actuator may be latched in that position by the user engaging the user manipulatable knob 270, to pivot the knob upward as shown in FIG. 13*a* and allowing the leaf spring 850*a* to expand, so that the pawl 884 engages the teeth 882 of the rack 880 to latch the slide actuator 230 in the desired position with the spring tension supplied by the leaf spring 850*a*. Slide actuator position 1310 (FIG. 13*a*) may correspond to the deployed, expanded positions of the wing engagement members 812, 814 as depicted in FIG. 12*b*, for example. In this example, the expander member 860 has been pushed forward along the longitudinal axis 1120 of the shoe treatment device by the link member 851 of the slide actuator, thereby driving the wing engagement members 812, 814 a particular equidistance apart and a particular equidistance forward. As a result, the lateral movements of the wing engagement members 812, 814 in the example of FIG. 12*b*, are symmetrical in the left-right relative to the longitudinal axis 1120 and equidistant in the toe-heel direction relative to a transverse axis 1130.

In one embodiment, the expander member 860 may travel approximately one inch from the stowed position of FIG. 12*a* to the deployed position of FIG. 12*b*. The wing engagement members may as a result of this travel of the expander member, in one embodiment, separate from each other a left/right (transverse) distance of approximately three-quarters of an inch from the stowed position of FIG. 12*a* to the deployed position of FIG. 12*b*. Thus, each wing engagement member travels laterally a distance of approximately three-eighths of an inch in response to the expander member travel of approximately one inch in the longitudinal direction. Further, the wing engagement members may as a result, in one embodiment, travel forward a longitudinal distance of approximately one-eighth of an inch from the stowed position of FIG. 12*a* to the deployed position of FIG. 12*b*. Thus, the ratio of the expander longitudinal travel to the wing engagement member left-right lateral travel is approximately 3 to 1 in the illustrated embodiment, and the ratio of the expander forward longitudinal travel to the wing engagement member forward longitudinal travel is approximately 8 to 1. It is believed that a ratio of expander travel to wing engagement member travel in excess of unity facilitates ease of use of the shoe treatment device.

In the contracted, stowed positions of the engagement members 812, 814 depicted in FIG. 12*a*, the guide pins 866*a*, 866*b*, 868*a*, 868*b* may be positioned toward the forward edge and distal end of the associated guide slot 870*a*, 870*b*, 872*a*, 872*b*, respectively. By comparison, as a result of the lateral movement of the engagement members 812, 814 as depicted in FIG. 12*b*, the guide slots 870*a*, 870*b*, 872*a*, 872*b* may have moved relative to the associated guide pins 866*a*, 866*b*, 868*a*, 868*b*, respectively, such that the guide pins 866*a*, 866*b*, 868*a*, 868*b* may be positioned toward the center of the associated guide slot 870*a*, 870*b*, 872*a*, 872*b*, respectively.

As previously mentioned, the farther forward the knob 270 is pushed toward the front of the shoe treatment device, the greater the degree of expansion of the interior engagement form 120 as indicated by the arrow 1304. Slide actuator position 1320 (FIG. 13*a*) may correspond to another deployed, expanded position of the wing engagement members 812, 814 as depicted in FIG. 12*c*, for example. In this example, the expander member 860 has been pushed further along the longitudinal axis 1120 of the shoe treatment device by the link member 851 of the slide actuator, in the forward direction, as compared to that shown in FIG. 12*b*. In the example, of FIG. 12*c*, the shoe exerts greater resistance to lateral movement of the right wing engagement member 814 as compared to that exerted upon the left wing engagement member. As a result of such resistance by the shoe, in this example, the right wing engagement member 814 stops at a position similar to that depicted for the right wing engagement member 814 in FIG. 12*b*. Hence, as a result of the lateral movement of the engagement member 814 as depicted in FIG. 12*c*, the guide slots 872*a*, 872*b* may have moved relative to the associated guide pins, 868*a*, 868*b*, respectively, such that the guide pins 868*a*, 868*b* may remain positioned toward the center of the associated guide slot 872*a*, 872*b*, respectively.

In accordance with another aspect of the present description, the shoe treatment device can accommodate asymmetric lateral movements of the wing engagement members 812, 814. In the illustrated embodiment, the expander member 860 is coupled to the slide actuator link member 851 by a coupler 1400 integrally formed with the link member 851. The coupler 1400 defines a guide slot 1410 which receives a coupler pin 1420 of the link member 851. The guide slot 1410 permits the expander member 860 to move laterally relative to the link member 851. The coupler pin 1420 has a cap member 1430 which, in the illustrated embodiment, has a diameter of sufficient size to retain the coupler pin 1420 in the guide slot 1410.

In the examples of FIGS. 12*a*, 12*b*, the expander member 860 moves aligned with the longitudinal axis 1120 and the link member 851. Hence, the coupler pin 1420 is depicted centered in the guide slot 1410 of the coupler 1400 in the examples of FIGS. 12, 12*b*.

Should one of the wing engagement members such as the wing engagement member 814 encounter sufficient resistance to continued lateral movement such that the lateral movement of the member 814 ends at the position indicated in FIG. 12*c*, continued forward movement of the link member 851 as the slide actuator 230 continues to slide forward from the position 1310 toward the position 1320, continues to drive the expander member 860 forward relative to the transverse axis 1130 and to the left of the longitudinal axis 1120 as depicted in FIG. 12*c*. As a result, although the wing engagement member 814 remains in the expanded state depicted in FIGS. 12*b*, 12*c*, the wing engagement member 812 continues to slide laterally both in the forward direction and in the leftward direction as shown in FIG. 12*c*. As a result the wing engagement members 812, 814 are driven an asymmetric distance apart and an asymmetric distance forward. As a result, the lateral movements of the wing engagement members 812, 814 in the example of FIG. 12*b*, are asymmetrical in the left-right direction about the longitudinal axis 1120 and asymmetrical in the toe-heel direction relative to a transverse axis 1130. Accordingly, the coupler pin 1420 secured to the expander member 860 is depicted as moving leftward with the expander member 860 toward the left end of the guide slot 1410 of the coupler 1400. In this manner, the coupler 1400 accommodates left-right lateral displacement of the expander member 860 relative to the link member 851 and the longitudinal axis 1120.

As previously mentioned, in the contracted, stowed positions of the engagement members 812, 814 depicted in FIG. 12*a*, the guide pins 866*a*, 866*b*, 868*a*, 868*b* may be positioned toward the forward edge and distal end of the associated guide slot 870*a*, 870*b*, 872*a*, 872*b*, respectively. Also, as a result of the lateral movement of the engagement member 814 as depicted in FIG. 12*c*, the guide slots 872*a*, 872*b* may have moved relative to the associated guide pins 868*a*, 868*b*, respectively, such that the guide pins 868*a*, 868*b* may be positioned toward the center of the associated guide slot 872*a*, 872*b*, respectively. However, as a result of the further lateral movement of the engagement members 812 as depicted in FIG. 12*c*, the guide slots 870*a*, 870*b* may have moved relative to the associated guide pins 866*a*, 866*b*, such that the guide pins 866*a*, 866*b* may be positioned toward the rearward edge and the proximal (right) end of the associated guide slot 870*a*, 870*b*, respectively. In one embodiment, the nose member 834 (FIG. 10) of the base 292 may define angled guide surfaces 1140 as shown in phantom in FIG. 12*c* to guide the longitudinal and lateral travel of the wing engagement members 812, 814.

Thus, the user may push the knob 270 along the rack 880 until the desired degree of expansion has been achieved, providing a suitable amount of shoe shape maintenance or shoe size stretching, as appropriate. At that point, the user may pivot the knob 270 until the pawl 884 reengages the teeth 882 of the rack 880 at the appropriate position to relatch the knob 270 of the slide actuator 230 at that position, which may be position 1310, or position 1320, for example which are represented in phantom in FIG. 13*a*. In the illustrated embodiment, each tooth 882 of the rack 880 defines a latch position and a corresponding selectable expanded (or contracted) state of the interior engagement form 120. It is believed that the number of individual latch positions and associated engagement form expansion/contraction states may be in a range of 2-20, for example. However, it is appreciated that the number of such individual latch positions and associated engagement form expansion/contraction states may vary, depending upon the particular application.

Figure 14A:
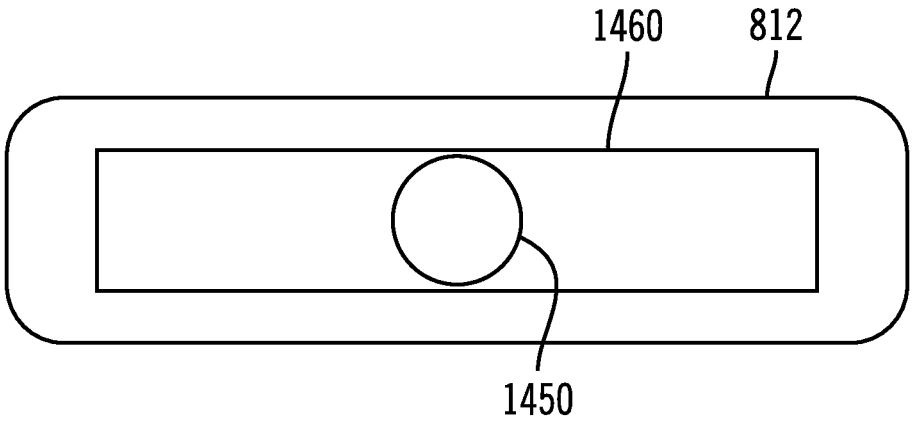
FIG. 14*a* is a side view of a wing engagement member having a foot feature simulating extension member in accordance with one aspect of the present description.
Figure 14B:
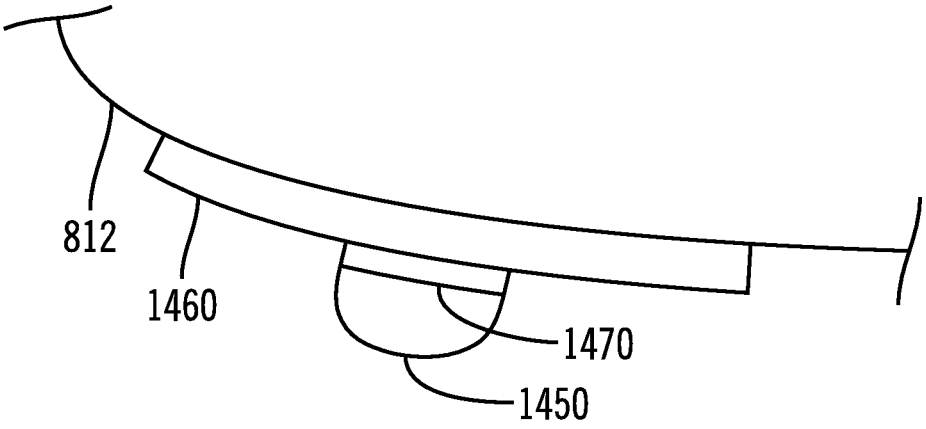
FIG. 14*b* is a top view of the foot feature simulating extension member of FIG. 14*a*.

In accordance with another aspect of the present description, the interior engagement form 120 may have one or more foot feature extension members 1450 (FIGS. 14*a*, 14*b*) which are shaped to simulate a bunion or other foot feature which the device user may have on one or more of the user's feet. The foot feature simulating extension member 1450 may be fastened to the exterior of a wing engagement member as represented by the wing engagement member 812, for example.

In the illustrated embodiment, the wing engagement member has a hook and loop type fastener strip 1460 affixed to the side of the wing engagement member 812. The foot feature simulating extension member 1450 has a cooperating hook and loop type fastener strip 1470 (FIG. 14*b*) affixed to the bottom of the bunion simulating extension member 1450. Accordingly, the foot feature simulating extension member 1450 may be readily attached to the wing engagement member 812 at an appropriate location along the length of the fastener strip 1460 to match the corresponding location of the actual bunion or foot feature on the user's foot. The foot feature simulating extension member 1450 may be readily unfastened from the fastener strip 1460 and relocated and refastened as appropriate on the fastener strip 1460 to simulate the location of the actual bunion or other foot feature. In this manner, the shoe treatment device 110 may treat the user's shoes to maintain shape and stretch the shoe as appropriate to accommodate special needs such as a bunion, for example.

The shoe treatment device may include an assortment of bunion or other foot feature simulating extension members similar to the foot feature simulating extension member 1450 in various shapes and sizes to accommodate different shapes and sizes of bunions or other foot features of the user. Upon selecting the appropriate bunion or other foot feature simulating extension member 1450, the member 1450 may be attached to the appropriate wing extension member. In one embodiment, the foot feature simulating extension member 1450 may be covered by the fabric enclosure 130. In other embodiments, the fabric enclosure 130 may be omitted.

It is believed that the independent deployment of the engagement members of expandable toe box interior engagement form 120, permits the shape of the expandable toe box interior engagement form 120 in the expanded state, to be flexible and to readily conform to a variety of different toe box shapes and sizes. In contrast, prior shoe treatment devices having a relatively inflexible shape may not conform to many types of shoes such that the shoe treatment device may pop out of the shoe, reducing or eliminating any benefit of the shoe treatment device.

To remove the shoe treatment device, the user may again engage the user manipulatable knob 270, using the user's thumb, for example, to pivot the knob 270 as shown in FIG. 13*b* and to contract the leaf spring 850*a*, so that the pawl 884 disengages from the rack 880 to unlatch the slide actuator 230. In the unlatched position, the user may pull the knob 270 toward the rear of the shoe treatment device. As indicated by the arrow 1304, pulling the knob 270 of the slide actuator 230 toward the rear or heel of the shoe treatment device causes the interior engagement form 120 (FIG. 2*a*) to contract. In one embodiment, the form 120 may contract as the slide actuator 230 is moved rearward, while the form 120 remains in place in the toe box until the desired degree of contraction is achieved. In general, the farther forward the knob 270 is pushed toward the rear of the shoe treatment device, the greater the degree of contraction of the interior engagement form 120 as indicated by the arrow 1304.

Once the slide actuator reaches a desired position for removal of the treatment device, the slide actuator may be latched in that position by the user again engaging the user manipulatable knob 270, to pivot the knob upward as shown in FIG. 13*a* and allowing the leaf spring 850*a* to expand, so that the pawl 884 engages the teeth 882 of the rack 880 to latch the slide actuator 230 in the desired position. Slide actuator position 1300 (FIG. 13*a*) may correspond to the stowed, contracted positions of the wing engagement members 812, 814 as depicted in FIG. 12*a*, for example. In this example, the expander member 860 has been pulled backward along the longitudinal axis 1120 of the shoe treatment device by the link member 851 of the slide actuator, thereby allowing the wing engagement members 812, 814 biased by the spring 844 (FIG. 8*b*) to return to the stowed position to facilitate removal of the treatment device from the shoe. Once the form 120 has been contracted and latched in the desired contraction state, the form may be readily removed from the toe box reducing or eliminating potential damage to the shoe caused by withdrawal of the treatment device.

It is believed that the shoe treatment devices having a slide actuator in accordance with the present description may be used to substantially maintain, the original shape and fit of a shoe, or to stretch a shoe as appropriate Other aspects may be realized in addition thereto or instead of those described herein, depending upon the particular application.

EXAMPLES

The following examples pertain to further embodiments.

Example 1 is directed to a method, comprising: inserting a shoe treatment device having an expandable, interior engagement form into the interior of a toe box of a shoe while the expandable toe box interior engagement form is in a latched, contracted state; unlatching the expandable toe box interior engagement form from the latched, contracted state; sliding a movable slide actuator and link member coupling the slide actuator to the expandable toe box interior engagement form, along an arm of the of the device, from a first position to a second position toward the expandable toe box interior engagement form; expanding the expandable toe box interior engagement form to an expanded state while in the interior of the toe box of the shoe as the movable slide actuator and the link member slide to the second position, to treat the interior of the toe box of the shoe; and latching the expandable toe box interior engagement form in the expanded state while in the interior of the toe box of the shoe.

In Example 2, the subject matter of Examples 1-13 (excluding the present Example) can optionally include pivoting the arm wherein the link member extends from the interior of the shoe to the exterior of the shoe and the pivoting arm extends to the exterior of the shoe so that the first and second positions of the movable slide actuator are both exterior to the shoe.

In Example 3, the subject matter of Examples 1-13 (excluding the present Example) can optionally include wherein the sliding the movable slide actuator and the link member includes sliding the movable slide actuator and the link member along a guide track disposed within the arm and guiding the movable slide actuator and the link member from the first position to the second position.

In Example 4, the subject matter of Examples 1-13 (excluding the present Example) can optionally include wherein the latching the expandable toe box interior engagement form in the expanded state includes engaging the movable slide actuator with a ratchet latch disposed along the guide track and in the second position of the movable slide actuator.

In Example 5, the subject matter of Examples 1-13 (excluding the present Example) can optionally include wherein the sliding the movable slide actuator includes sliding the movable slide actuator along a guide slot defined by a housing of the arm, and configured to guide the movable slide actuator from the first position to the second position.

In Example 6, the subject matter of Examples 1-13 (excluding the present Example) can optionally include wherein the engaging the movable slide actuator with a ratchet latch includes moving a spring tensioned pawl of the movable slide actuator from an unengaged position to an engaged position in which the pawl engages the ratchet latch of the guide member.

In Example 7, the subject matter of Examples 1-13 (excluding the present Example) can optionally include wherein the sliding the movable slide actuator includes engaging a button of the slide actuator with a user's thumb to slide the movable slide actuator between the first and second positions and wherein moving the pawl between the engaged and disengaged positions includes moving the button of the slide actuator with the user's thumb.

In Example 8, the subject matter of Examples 1-13 (excluding the present Example) can optionally include wherein the link member is ribbon-shaped and wherein expanding the expandable toe box interior engagement form to the expanded state as the movable slide actuator slides to the second position, includes driving a wedge-shaped expander member coupled to the movable slide actuator by the ribbon-shaped link member, and positioned between and engaging opposing wing engagement members of the expandable toe box interior engagement form as the movable slide actuator slides to the second position, wherein the ribbon-shaped link member drives the wedge-shaped expander member forward toward the front of the toe box of the shoe, and drives the wing engagement members apart.

In Example 9, the subject matter of Examples 1-13 (excluding the present Example) can optionally include wherein the expanding the expandable toe box interior engagement form to the expanded state as the movable slide actuator slides to the second position, includes the expander member shifting laterally in a left-right direction within the toe box area so that one wing member may be driven outwardly more than the other wing member.

In Example 10, the subject matter of Examples 1-13 (excluding the present Example) can optionally include: unlatching the expandable toe box interior engagement form from the expanded state while in the interior of the toe box of the shoe; sliding the movable slide actuator from the second position toward the first position; contracting the expandable toe box interior engagement form to a contracted state while in the interior of the toe box of the shoe as the movable slide actuator slides toward the first position; latching the expandable toe box interior engagement form in the contracted state while in the interior of the toe box of the shoe; and removing the expandable toe box interior engagement form of the shoe treatment device from the interior of the toe box of the shoe.

In Example 11, the subject matter of Examples 1-13 (excluding the present Example) can optionally include wherein the unlatching the expandable toe box interior engagement form includes disengaging the movable slide actuator from ratchet teeth of a ratchet latch disposed along a guide member guiding the movable slide actuator and wherein the disengaging the movable slide actuator from ratchet teeth of the ratchet latch includes pivoting a pawl of the movable slide actuator from an engaged position to a disengaged position in which the pawl disengages from the ratchet teeth of the ratchet latch.

In Example 12, the subject matter of Examples 1-13 (excluding the present Example) can optionally include wherein the contracting the expandable toe box interior engagement form to a contracted state while in the interior of the toe box of the shoe as the movable slide actuator slides toward the first position includes the movable slide actuator pulling the link member and the expander member backward away from the front of the toe box of the shoe, and a spring member drawing the wing engagement members inwardly back together.

In Example 13, the subject matter of Examples 1-13 (excluding the present Example) can optionally include selectively attaching and removing removable foot extension features to and from the engagement form.

Example 14 is directed to a shoe treatment device for use with a shoe having a toe box, comprising: an expandable, interior engagement form having a contracted state and expandable to an expanded state wherein the expandable, interior engagement form is configured to engage the interior of the toe box of the shoe in the expanded state; an arm coupled to the engagement form; a movable slide actuator disposed on the arm and configured to slide along the arm from a first position to a second position; a link member coupling the slide actuator to the interior engagement form and configured to slide along the arm from a first position to a second position, wherein the expandable toe box interior engagement form is configured to expand to the expanded state as the movable slide actuator slides to the second position; and a latch configured to selectively latch the expandable toe box interior engagement form in a selected state of a plurality of states including the contracted state and the expanded state.

In Example 15, the subject matter of Examples 14-23 (excluding the present Example) can optionally include wherein the link member is configured to extend from the interior of the shoe to the exterior of the shoe and the arm is configured to pivot and extend to the exterior of the shoe so that the first and second positions of the movable slide actuator are both exterior to the shoe when the device is used with a shoe.

In Example 16, the subject matter of Examples 14-23 (excluding the present Example) can optionally include a guide track disposed within the arm and configured to guide the movable slide actuator and the link member between their respective first position and second position.

In Example 17, the subject matter of Examples 14-23 (excluding the present Example) can optionally include wherein the latch is a ratchet latch having ratchet teeth disposed along the guide track and configured to releasably latch the movable slide actuator in the second position of the movable slide actuator to latch the expandable toe box interior engagement form in the expanded state.

In Example 18, the subject matter of Examples 14-23 (excluding the present Example) can optionally include wherein the arm comprises a housing configured to house the slide actuator and the ratchet latch and defining a guide slot configured to guide the movable slide actuator from the first position to the second position of the movable slide actuator.

In Example 19, the subject matter of Examples 14-23 (excluding the present Example) can optionally include wherein the link member is ribbon shaped and the slide actuator comprises a movable pawl and a C-shaped ribbon spring extending integrally from the ribbon-shaped link member and coupling the pawl to the link member, said pawl configured to move with spring tension supplied by said C-shaped ribbon spring from an unengaged position to an engaged position in which the pawl engages the ratchet latch.

In Example 20, the subject matter of Examples 14-23 (excluding the present Example) can optionally include wherein the movable slide actuator comprises a button configured to be engaged by a user's thumb to slide the movable slide actuator between the first and second positions of the movable slide actuator and to move the pawl between the engaged and disengaged positions.

In Example 21, the subject matter of Examples 14-23 (excluding the present Example) can optionally include wherein the link member is ribbon-shaped and wherein the expandable toe box interior engagement form includes opposing wing engagement members, a spring biasing the wing engagement members together, and a wedge-shaped expander member coupled to the movable slide actuator by the ribbon-shaped link member, and positioned between and configured to engage the opposing wing engagement members of the expandable toe box interior engagement form as the movable slide actuator slides to the second position of the actuator, driving the link member and the expander member forward toward the front of the toe box of the shoe, and driving the wing engagement members apart.

In Example 22, the subject matter of Examples 14-23 (excluding the present Example) can optionally include wherein the expander member is configured to shift laterally in a left-right direction within the toe box area so that one wing member may be driven outwardly more than the other wing member.

In Example 23, the subject matter of Examples 14-22 (excluding the present Example) can optionally include removable foot extension features removably attached to the engagement form.

Example 24 is directed to an apparatus comprising means to perform a method as described in any preceding Example 1-13.

The foregoing description of various embodiments has been presented for the purposes of illustration and description. It is not intended to be exhaustive or to limit to the precise form disclosed. Many modifications and variations are possible in light of the above teaching.

What is claimed is:

1. A method, comprising:

inserting a shoe treatment device having an expandable, interior engagement form into the interior of a toe box of a shoe while the expandable toe box interior engagement form is in a latched, contracted state;

unlatching the expandable toe box interior engagement form from the latched, contracted state;

sliding a movable slide actuator and link member coupling the slide actuator to the expandable toe box interior engagement form, along an arm of the device coupled to a platform of the toe box interior engagement form, from a first position to a second position toward the expandable toe box interior engagement form;

expanding the expandable toe box interior engagement form to an expanded state while in the interior of the toe box of the shoe as the movable slide actuator and the link member slide to the second position, to treat the interior of the toe box of the shoe, said expanding including sliding wing engagement members on a supporting slide surface of the platform in a sliding motion between the contracted state and the expanded state; and latching the expandable toe box interior engagement form in the expanded state while in the interior of the toe box of the shoe; and wherein the link member is ribbon-shaped and wherein expanding the expandable toe box interior engagement form to the expanded state as the movable slide actuator slides to the second position, includes driving a wedge-shaped expander member coupled to the movable slide actuator by the ribbon-shaped link member which is coupled to the expander member by a coupler, and positioned between and engaging opposing wing engagement members of the expandable toe box interior engagement form as the movable slide actuator slides to the second position, wherein the ribbon-shaped link member drives the wedge-shaped expander member forward toward the front of the toe box of the shoe, and drives the wing engagement members apart.

2. The method of claim 1 further comprising pivoting the arm in a pivot direction and flexing the link member in the pivot direction as the arm pivots wherein the link member extends from the interior of the shoe to the exterior of the shoe and the pivoting arm extends to the exterior of the shoe so that the first and second positions of the movable slide actuator are both exterior to the shoe.

3. The method of claim 2 wherein sliding the movable slide actuator and the link member includes sliding the movable slide actuator and the link member along a guide track disposed within the arm and guiding the movable slide actuator and the link member from the first position to the second position.

4. The method of claim 3 wherein latching the expandable toe box interior engagement form in the expanded state includes engaging the movable slide actuator with a ratchet latch disposed along the guide track and in the second position of the movable slide actuator.

5. The method of claim 4 wherein sliding the movable slide actuator includes sliding the movable slide actuator along a guide slot defined by a housing of the arm, and configured to guide the movable slide actuator from the first position to the second position.

6. The method of claim 5 wherein engaging the movable slide actuator with a ratchet latch includes moving a spring tensioned pawl of the movable slide actuator from an unengaged position to an engaged position in which the pawl engages the ratchet latch of the guide track with a spring force being applied to the pawl by the link member.

7. The method of claim 6 wherein sliding the movable slide actuator includes engaging a button of the slide actuator with a user's thumb to slide the movable slide actuator between the first and second positions and wherein moving the pawl between the engaged and disengaged positions includes moving the button of the slide actuator with the user's thumb.

8. The method of claim 1 wherein the coupler includes a pin carried by the expander member and a slot defined by the link member, and the expanding the expandable toe box interior engagement form to the expanded state as the movable slide actuator slides to the second position, includes the coupler pin carried by the expander member shifting laterally in the slot defined by the link member in a left-right direction within the toe box area so that one wing member may be driven outwardly more than the other wing member.

9. The method of claim 1 further comprising:

unlatching the expandable toe box interior engagement form from the expanded state while in the interior of the toe box of the shoe;

sliding the movable slide actuator from the second position toward the first position;

contracting the expandable toe box interior engagement form to a contracted state while in the interior of the toe box of the shoe as the movable slide actuator slides toward the first position;

latching the expandable toe box interior engagement form in the contracted state while in the interior of the toe box of the shoe; and removing the expandable toe box interior engagement form of the shoe treatment device from the interior of the toe box of the shoe.

10. The method of claim 9 wherein unlatching the expandable toe box interior engagement form includes disengaging the movable slide actuator from ratchet teeth of a ratchet latch disposed along a guide member guiding the movable slide actuator and wherein the disengaging the movable slide actuator from ratchet teeth of the ratchet latch includes pivoting a pawl of the movable slide actuator from an engaged position to a disengaged position in which the pawl disengages from the ratchet teeth of the ratchet latch.

11. The method of claim 9 wherein contracting the expandable toe box interior engagement form to a contracted state while in the interior of the toe box of the shoe as the movable slide actuator slides toward the first position includes the movable slide actuator pulling the link member and the expander member backward away from the front of the toe box of the shoe, and a spring member drawing the wing engagement members inwardly back together.

12. A shoe treatment device for use with a shoe having a toe box, comprising:

an expandable, interior engagement form having a contracted state and expandable to an expanded state wherein the expandable, interior engagement form is configured to engage the interior of the toe box of the shoe in the expanded state, wherein the interior engagement form includes opposing wing engagement members and a platform having a supporting slide surface which supports the wing engagement members for sliding motion between the contracted state and the expanded state;

an arm coupled to the platform of the engagement form;

a movable slide actuator disposed on the arm and configured to slide along the arm from a first position to a second position;

a link member coupling the slide actuator to the interior engagement form and configured to slide along the arm from a first position to a second position, wherein the expandable toe box interior engagement form is configured to expand to the expanded state as the movable slide actuator slides to the second position; and a latch configured to selectively latch the expandable toe box interior engagement form in a selected state of a plurality of states including the contracted state and the expanded state; and wherein the link member is ribbon-shaped and wherein the expandable toe box interior engagement form includes a spring biasing the wing engagement members together, a coupler and a wedge-shaped expander member coupled to the movable slide actuator by the ribbon-shaped link member which is coupled to the expander member by the coupler, and positioned between and configured to engage the opposing wing engagement members of the expandable toe box interior engagement form as the movable slide actuator slides to the second position of the actuator, driving the link member and the expander member forward toward the front of the toe box of the shoe, and driving the wing engagement members apart.

13. The shoe treatment device of claim 12 wherein the link member is flexible in a pivot direction and is configured to extend from the interior of the shoe to the exterior of the shoe and wherein the arm is pivotally coupled to the platform of the engagement form and is configured to pivot in the pivot direction and to flex the link member in the pivot direction as the arm pivots in the pivot direction and is further configured to extend to the exterior of the shoe so that the first and second positions of the movable slide actuator are both exterior to the shoe when the device is used with a shoe.

14. The shoe treatment device of claim 13 further comprising a guide track disposed within the arm and configured to guide the movable slide actuator and the link member between their respective first position and second position.

15. The shoe treatment device of claim 14 wherein the latch is a ratchet latch having ratchet teeth disposed along the guide track and configured to releasably latch the movable slide actuator in the second position of the movable slide actuator to latch the expandable toe box interior engagement form in the expanded state.

16. The shoe treatment device of claim 15 wherein the arm comprises a housing configured to house the slide actuator and the ratchet latch and defining a guide slot configured to guide the movable slide actuator from the first position to the second position of the movable slide actuator.

17. The shoe treatment device of claim 16 wherein the slide actuator comprises a movable pawl and a C-shaped ribbon spring extending integrally from the ribbon-shaped link member and coupling the pawl to the link member, said pawl configured to move with spring tension supplied by said C-shaped ribbon spring from a disengaged position to an engaged position in which the pawl engages the ratchet latch.

18. The shoe treatment device of claim 17 wherein the movable slide actuator comprises a button configured to be engaged by a user's thumb to slide the movable slide actuator between the first and second positions of the movable slide actuator and to move the pawl between the engaged and disengaged positions.

19. The shoe treatment device of claim 12 wherein the coupler includes a pin carried by the expander member and a slot defined by the link member, and oriented in a left-right direction in the toe box of the shoe and wherein the expander member is configured to shift the coupler pin laterally within the link member slot in the left-right direction within the toe box area so that one wing member may be driven outwardly more than the other wing member.

* * * * *